United States Patent [19]

Hutchison et al.

[11] Patent Number: 4,591,006

[45] Date of Patent: May 27, 1986

[54] WELL SERVICING RIG

[75] Inventors: Stanley O. Hutchison; Paul V. Oldershaw; James E. Hansen, all of Bakersfield, Calif.

[73] Assignee: Chevron Research Company, San Francisco, Calif.

[21] Appl. No.: 427,096

[22] Filed: Sep. 29, 1982

Related U.S. Application Data

[63] Continuation of Ser. No. 247,674, Mar. 26, 1981, abandoned.

[51] Int. Cl.[4] ..... E21B 19/20

[52] U.S. Cl. ..... 175/52; 175/85

[58] Field of Search ..... 175/52, 85, 57; 414/22

[56] References Cited

U.S. PATENT DOCUMENTS

| | | | |
|---|---|---|---|
| Re. 26,284 | 10/1967 | O'Neill et al. | 175/57 |
| 3,177,944 | 4/1965 | Knights | 175/85 X |
| 3,404,741 | 10/1968 | Gheorghe et al. | 175/85 |
| 3,499,498 | 3/1970 | Bromell et al. | 175/52 |
| 3,682,259 | 8/1972 | Cintract et al. | 414/22 X |
| 3,710,954 | 1/1973 | Hutchison | 214/2.5 |
| 3,734,210 | 5/1973 | Wilderman | 175/85 |
| 3,870,109 | 3/1975 | Gray | 175/85 X |
| 4,042,123 | 8/1977 | Sheldon et al. | 175/85 X |

*Primary Examiner*—James A. Leppink
*Assistant Examiner*—Hoang C. Dang
*Attorney, Agent, or Firm*—J. A. Buchanan, Jr.; E. J. Keeling

[57] ABSTRACT

A fully mobil and totally contained well servicing and drilling rig is disclosed having equipment on the rig for automatically handling well elements (pipe, tubing and rods) going into and coming out of a well. The rig provides well element storage racks, cranes for moving well elements onto and off the tracks, transfer means for moving well elements from horizontal to vertical position, well element conveying means for moving elements to and from the transfer means, an automatic manipulator for moving elements into alignment with the well being serviced, automatic hoisting means, means for connecting and disconnecting elements from the element string within the well, driving means for all of the equipment, and control means for sequencing and operating all of the means so that the entire well servicing or drilling can be accomplished without human handling of well elements in the vicinity of the well head and rig.

31 Claims, 47 Drawing Figures

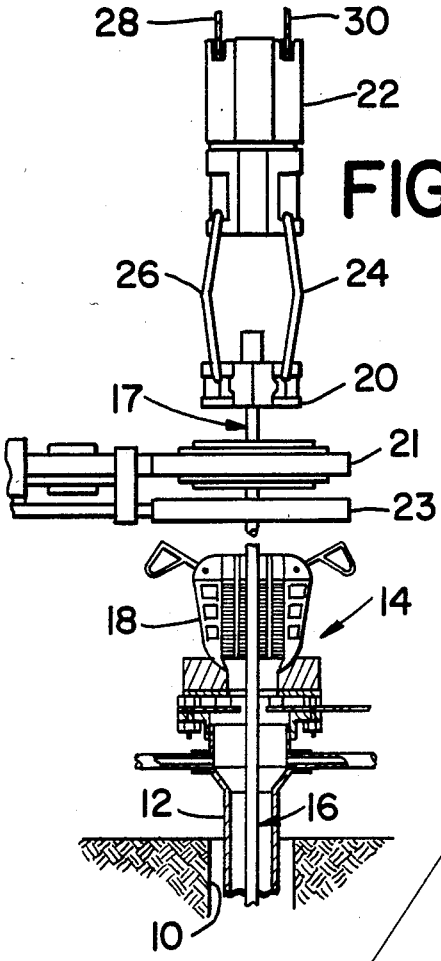
FIG_1A
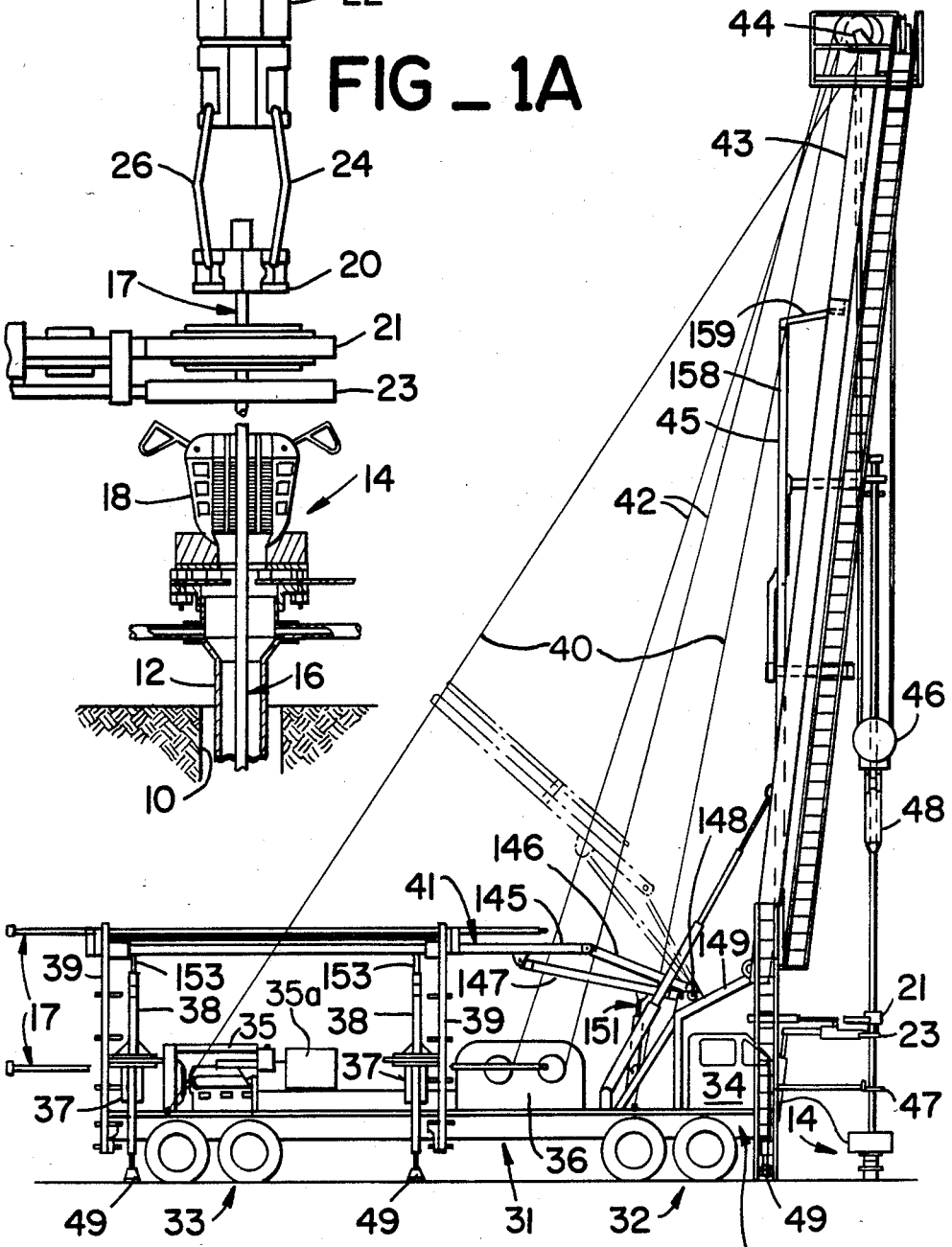
FIG_1
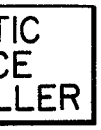

PULLING OUT OF WELL BORE
TIME IN SECONDS
1 GATE 97 EXTEND RETRACT
2 INDEXER 99 EXTEND RETRACT
3 PIPE CONVEYOR 39 OUT (CW) IN (C'CW)
HOLD AT 4 FOR 8
4 TRANSFER ARM HANDS LEFT OR RIGHT SIDE 144 OPEN CLOSE
5 TRANSFER ARM LEFT OR RIGHT SIDE 145 VERTICAL HORIZ.
37A-1
37A-2
37A-3
37A-4
37A-5
ENTERING WELL BORE
TIME IN SECONDS
HOLD AT 2 FOR 1
HOLD AT 3 FOR 5

PULLING OUT OF WELL BORE
TIME IN SECONDS
12 HORIZ. ACTUATOR 271 (TONGS) EXTEND RETRACT
13 VERT. ACTUATOR 264 (TONGS) REVERSE FOR RODS EXTEND RETRACT
14 TONGS 21 MAKE (CW) BREAK (CCW)
15 CENTRALIZER 47 CLOSED OPEN
16 SLIPS 50 SET RELEASE
17 ELEVATOR JAWS 227, 228 OPEN CLOSE
37C-12
37C-13
37C-14
37C-15
37C-16
37C-17
ENTERING WELL BORE
TIME IN SECONDS

SENSOR A- ENTERING HOLE B - PULLING OUT

| | START UP | | 1 | 2 | 3 | 4 | 5 | 6 | 7 | 8 | 9 | 10 |
|---|---|---|---|---|---|---|---|---|---|---|---|---|
| 1. | SET CONTROLS FOR ENTERING OR PULLING OUT | | PIPE IN INDEXER (LEFT OR RIGHT SIDE) | BOTTOM - PIPE CONV. (LEFT OR RIGHT SIDE) | TOP -PIPE CONV. (LEFT OR RIGHT SIDE) | BACK SIDE - PIPE CONV. (LEFT OR RIGHT SIDE) | TRANSFER ARM - HORIZ. (LEFT OR RIGHT SIDE) | TRANSFER ARM - VERT. (LEFT OR RIGHT SIDE) | OBJECT IN HANDS TRANSFER HNDS (L OR R SIDE) | PRESSURE SENSOR - OPEN (TRANS ARM HAND) (LH-RH) | PRESSURE SENSOR-CLOSED (TRANS ARM HAND) (LH-RH) | APM AT TOP |
| | ACTUATOR | | A B | A B | A B | A B | A B | A B | A B | A B | A B | A B |
| 1 | GATE 97 CONT. RETRACT- PULLING OUT | EXTEND<br>RETRACT | 1 | | 1 | | | | | | | |
| 2 | INDEXER 99 CONT. RETRACT-PULLING OUT | EXTEND<br>RETRACT | 1 | 1 | | | | | | | | |
| 3 | PIPE CONVEYOR 39 | HOLD CW<br>HOLD C'CW | 1 | 0 | 0 | 0 | 1 | | | 1 | | |
| 4 | TRANSFER ARM HANDS (LEFT OR RIGHT SIDE) 144 | OPEN<br>CLOSE | | | | | 1 | | 1 1 | 0 0 | 0 0 | |
| 5 | TRANSFER ARM 145 (LEFT OR RIGHT SIDE) | VERTICAL<br>HORIZ. | | | 1 | | 0 0 | 0 0 | | 1 | 1 | |
| 6 | A.P.M. TOP HAND 167 | OPEN<br>CLOSED | | | | | | | | | 1 | |
| 7 | A.P.M. BTM. HAND 169 | OPEN<br>CLOSED | | | | | | | | | 1 | |
| 8 | A.P.M TOP ARM 166 | EXTEND<br>RETRACT | | | | | | 1 | | | | 1 |
| 9 | A.P.M. LOWER ARM 168 | EXTEND<br>RETRACT | | | | | | | | | | 1 |
| 10 | A.P.M. ROTATING ACTUATOR 171 | TO SIDE<br>TO ℄ | | | | | | | | 1 | | 1 |
| 11 | A.P.M VERTICAL ACTUATOR 170 | EXTEND<br>RETRACT | | | | | | | | | | 0 0 |
| 12 | HORIZ. ACTUATOR TONGS 271 | EXTEND<br>RETRACT | | | | | | | | | | |
| 13 | VERT. ACTUATOR TONGS TUBE (REVERSE FOR ROD) | EXTEND<br>RETRACT | | | | | | | | | | |
| 14 | TONGS 264 21 | CW - MAKE<br>C'CW-BREAK | | | | | | | | | | |
| 15 | CENTRALIZER 47 | CW-CLOSED<br>C'CW-OPEN | | | | | | | | | | |
| 16 | SLIPS - POWER 50 | SET<br>RELEASE | | | | | | | | | | |
| 17 | ELEVATOR JAWS 227, 228 | OPEN<br>CLOSE | | | | | | | | | | |
| 18 | DRAWWORKS CLUTCH | ENGAGE<br>RELEASE | | | | | | | | | | |
| 19 | DRAWWORKS BRAKE | SET<br>RELEASE | | | | | | | | | | |
| 20 | BACK UP ARM-TONGS 23 | EXTEND<br>RETRACT | | | | | | | | | | |
| 22 | ENGINE THROTTLE | | | | | | | | | | | |

FIG _ 38A

| 11 | 12 | 13 | 14 | 15 | 16 | 17 | 18 | 19 | 20 | 21 | 22 | 23 | 24 | 25 | 26 | 27 | 28 |
|---|---|---|---|---|---|---|---|---|---|---|---|---|---|---|---|---|---|
| APM AT BTM | APM ROTATION-SIDE LEFT OR RT | APM ROTATION-C ℄ | APM UPPER ARM 30"R | APM UPPER ARM 35"R | APM UPPER ARM 55"R | APM LOWER ARM 30"R | APM LOWER ARM 35"R | APM LOWER ARM 55"R | HAND OPEN (PRESSURE) APM UPPER HAND | HAND CLOSED (PRESSURE) APM UPPER HAND | HAND OPEN (PRESSURE) APM LOWER HAND | HAND CLOSED (PRESSURE) APM LOWER HAND | ELEVATOR AT 6'0" | ELEVATOR AT 8'0" | ELEVATOR AT 9'0" | ELEVATOR AT 11'0" | ELEVATOR AT 27'0" |
| A B | A B | A B | A B | A B | A B | A B | A B | A B | A B | A B | A B | A B | A B | A B | A B | A B | A B |
| | | | | | | | | | | | | | | | | | |
| | | | | | | | | | | | | | | | | | |
| | | | | | | | | | | | | | | | | | |
| | | | | | | | | | | 1 | | 1 | | | | | |
| | | | 1 | | | 1 | | | | | | | | | | | |
| | | | | 1 | 1 | | | | 0 0 | 0 0 | | | | | | | 1 |
| | | | | | | | 1 | | | | 0 0 | 0 0 | | | | | |
| 1 | 1 | | 0 | 0 | 0 0 | | | | 1 1 | | | | | | | 1 | |
| | 1 | 1 | | | | 0 0 | 0 0 | 0 0 | | | 1 1 | | | | | 1 | |
| | 0 0 | 0 0 | 1 | 1 | | 1 | 1 | | | | | | | | | | |
| 0 0 | | | 1 1 | 1 | 1 | 1 | | 1 | | | | | 1 | | | | |
| 1 | | | | | | | | | | | | | | | | | |
| | | | | | | | | | | | | | | | | | |
| | | | | | | | | | | | | | | | | | |
| | | | | | | | | | | | | | | 1 | | | 1 |
| | | | | | | | | | | | | | | 1 | | | 1 |
| 1 | | | | | | | | | | | | | 1 | | | 1 1 | |
| | | | | | | | | | | | | | 1 | | | | 1 |
| 1 | | | | | | | | | | | | | | | 1 | 1 1 | 1 |
| | | | | | | | | | | | | | | | | | |
| | | | | | | | | | | | | | | | | | |

FIG_38B

| | 47 | 48 | 49 | 50 | 51 | 52 | 53 | 54 | 55 | | | | | |
|---|---|---|---|---|---|---|---|---|---|---|---|---|---|---|
| | ELEVATOR JAWS-OPEN | ELEVATOR JAWS-CLOSED | BRAKES SET | SLIPS SET | APM TOP HAND SENSOR | APM BOTTOM HAND SENSOR | ELEVATOR AT 16'0" | ELEVATOR AT 32'0" | APM VERTICAL ACTUATOR EXTENDED 1 FOOT | | | | | |
| A B | A B | A B | A B | A B | A B | A B | A B | A B | A B | | | | | |
| | | | | | | | | | | | | | | |
| | | | | | | | | | | | | | | |
| | | | | | | | | |

WELL SERVICING RIG

This is a continuation of application Ser. No. 247,674, filed Mar. 26, 1981 now abandoned.

BACKGROUND OF THE INVENTION

This invention relates to an apparatus useful in handling elongated well elements such as pipe, tubing, and sucker rods and, more particularly, the invention relates to a mobile, totally contained and automatically operated servicing and drilling rig for use in oil well or other similar operations.

In oil well operations, elongated well elements such as tubing, pipe and sucker rods are used for such purposes as well production and well drilling. Individual well element sections are connected together to form an elongated segmented string for use in the well. The segmented string frequently comprises of the order of a hundred or more well elements.

A rig hoist is used to lower each successive section into the well to approximately its full length. After the section has been lowered to such a position, it is gripped near its upper end by suitable means, such as slips, to suspend it in the well. The hoist is then released from this section and a second section is supported from the hoist and then coupled to the first section. The second section is then lowered into the well to its full extent, and it is then held by the slips and the above sequence repeated. As this sequence is repeated, successive sections form a string which progressively goes deeper and deeper into the well.

If such a string is being removed from the well the hoist is connected to the uppermost section and the entire string is lifted until such section clears the well. The remaining string is hung by the slips in the wellhead and the uppermost section is then uncoupled and moved to a storage position. In the usual prior art field operations, the storage position is adjacent to the wellhead and sections, are transported from the storage position to the wellhead for connection to the hoist or removal therefrom by manual means. In other prior art systems separate mechanical conveying elements are required to operate the hoist and to transport the sections from the storage position to the hoist position.

In much of the prior art operations, several operators are required to perform all of the functions that are necessary to place a section into the hoist position, to connect or disconnect it from the string, and to run the string into the well or to remove it from the well. In some cases, this has required an operator at the wellhead level, an operator at an elevated position above the wellhead to connect or disconnect the sections from the hoist, and an operator to place the sections in the storage or to remove them from the storage position. Each of the operators involved in the operation of running well elements into and out of a well is in intimate contact with the wellhead and with the elements removed from the well.

Many of the petroleum wells today operate at elevated temperatures, either because of their depths within the earth formation or because of their operation in secondary recovery systems where steam or hot fluids are pumped into the well to cause the heavier crudes to become more mobile so as to flow toward the producing wells. In the treatment and operation of such wells, the removal of well elements becomes more difficult because of their elevated temperature. In some cases wells are cooled for many days through the procedure of pumping cold water into the well to bring the elements to a temperature where they may be safely handled by personnel. Automatic well element handling apparatus have been proposed to handle such elements so as to avoid the cooling step necessary to bring the element to a temperature where individuals may touch them.

SUMMARY OF THE INVENTION

The present invention is directed to an apparatus for handling elongated well elements wherein the apparatus is totally contained on a single movable vehicle and the handling of well elements from a storage position to a position for insertion within the well, or the reverse thereof for removal from the well to a position of storage, is accomplished totally automatically without the need for personnel at or close to the wellhead.

BRIEF DESCRIPTION OF THE INVENTION

A fully mobile and totally contained well servicing rig is provided. The rig includes means for storing, conveying and elevating individual elongated well elements which may include pipe, tubing and sucker rods, between a storage position and a position in alignment with a wellbore. The well element handling apparatus is totally automatic and provides means for tipping the well element from a horizontal storage position to a vertical operating position and the transfer of the well element to a transfer means and to a hoisting mechanism for operation with respect to the wellbore. The mobile rig further includes automatic tongs for connecting and disconnecting well elements from a string within the wellbore, automatic gripper means in the form of slips for preventing longitudinal movement of the string and automatic centralizing means for positioning the well elements with respect to the centerline of the wellbore. An integral part of the invention is an automatic control mechanism for controlling the sequential operation of each of the portions of the apparatus, so that well servicing operations can be conducted from a position remote from the wellhead. Each of the individual portions of the overall apparatus is designed to be stored on the mobile rig so that the rig and all of its operating elements is transportable as a unit from operation to operation.

OBJECTS OF THE INVENTION

A particular object of the present invention is to provide a self-containing, fully mobile well servicing rig that may be transported to the well head, set into operating position and operated with a minimum of manual control.

Further objects and advantages of the present invention will become apparent from the following detailed description read in light of the accompanying drawings which are made a part of this specification.

BRIEF DESCRIPTION OF THE DRAWINGS

FIG. 1 is a side elevational view of the mobile well servicing rig shown in its operational position with respect to a well head.

FIG. 1A is a schematic representation of a well head and the elements associated with the well head.

FIGS. 38A, 38B 38C and 38D are a chart representation of the sensor controls of the present invention.

DETAILED DESCRIPTION OF THE PREFERRED EMBODIMENT

Figure 3:
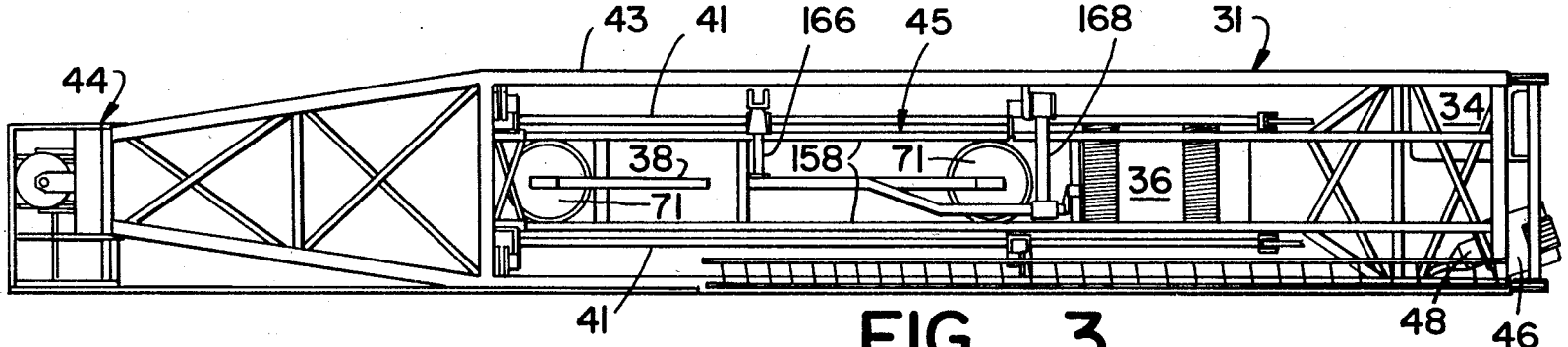
FIG. 3 is a top plan view of the well servicing rig in transport position.

The preferred form of apparatus assembled in accordance with the present invention is illustrated in FIG. 1 where the apparatus is shown in its operational position with elements erected for servicing operations with respect to a well penetrating the earth formation. The apparatus of the present invention is useful in handling elongated well elements between a horizontal storage position and a vertical operational position. Thus, the apparatus of the present invention is useful to lay down or pick up tubing, pipe and sucker rods for use within a well. Throughout this specification the terms "well elements", "tubing", "pipe" and "sucker rods" will be used interchangeably, in some cases the handling of rods and pipes or tubing will be different because of the physical dimensional differences in size between pipe, tubing and sucker rods. The terms "laying down tubing" and "picking up tubing" means, respectively, taking a tubing section which is disconnected from a tubing string and placing it in a horizontal manner on a pipe rack, or the like, and taking a tubing section from a horizontal position on a pipe rack, or the like, and positioning it in a vertical manner for connection with a tubing string.

As illustrated in FIG. 1A, the conventional environment in which the invention is useful, includes, for example, a well 10 containing a well casing 12 having a well head generally indicated by the number 14 located at the earth surface. A tubing string 16 extends down the well through the well head and through the tubing hanging slips 18 positioned on the well head 14. The tubing string is held by means of elevator 20 which is connected to traveling block 22 by means of elevator links 24 and 26. Hoist cables 28 and 30 connect the traveling block to a hoist (not shown). Power tongs 21 and back-up 23 are located above well head 14 to disconnected or to connect the threaded tubing sections into the tubing string.

The apparatus of the present invention is intended for use in the environment previously described and is designed to provide a totally contained well servicing apparatus that may be moved from well head to well head and will contain all of the necessary equipment for handling any of the well elements previously described and for laying down and picking up such well elements in a fully automatic manner. As illustrated in FIG. 1, the apparatus comprises a wheeled vehicle generally designated 31 having sets of wheels 32 and 33 at the front and rear of the vehicle, respectively. Power systems are provided on the vehicle including an operator's cab at 34 and a power drive system 35 for operating the vehicle and a winching system 36 all of which may be driven from a single power-driven system defined hereinafter.

Detailed figures will illustrate each of the elements of the assembled apparatus. However, in generality, FIG. 1 illustrates the pipe rack arms 37, the jib crane 38, the pipe conveyors 39, the transfer arms 41, the hoist cables 42, the derrick 43, the crown block 44, the automatic pipe manipulator 45, the traveling block 46, the power tongs 21, back-up tongs 23, slips 50, the centralizer 47, and the elevator 48. All of the foregoing equipment is supported on and provided with operating means that is also supported on the vehicle 31. When in operating position, the vehicle is leveled by a set of levelers 49 adapted to engage the earth surface.

Figure 2:
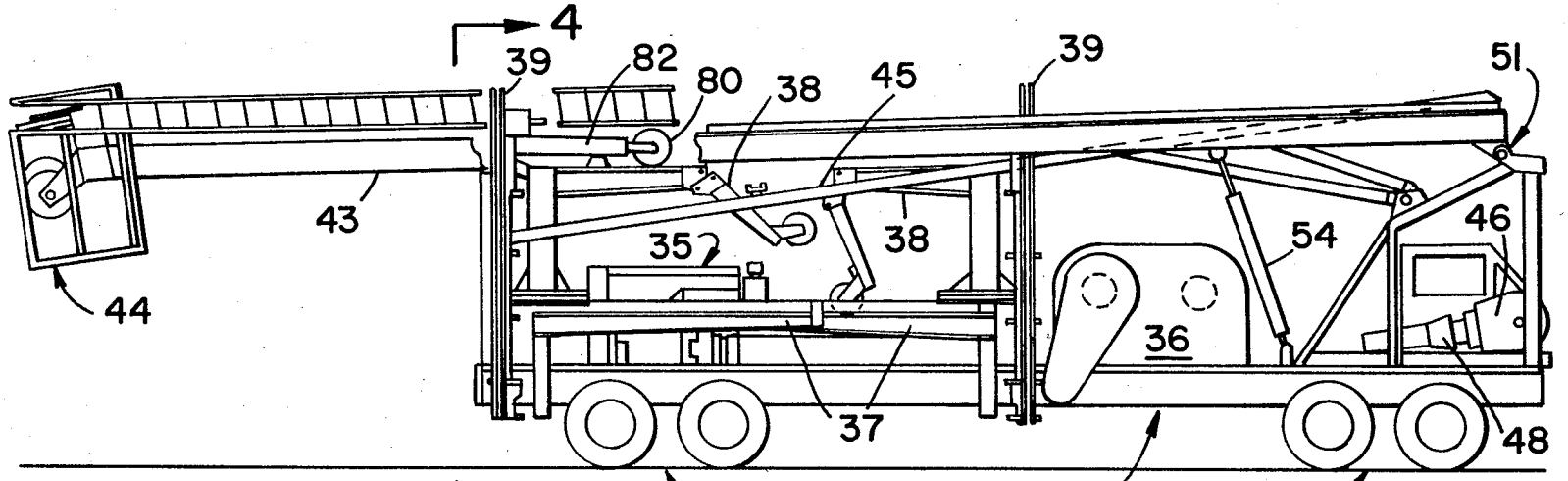
FIG. 2 is a side elevational view of the well servicing rig in its transport position with all elements of the rig stored for transport between well heads.
Figure 4:
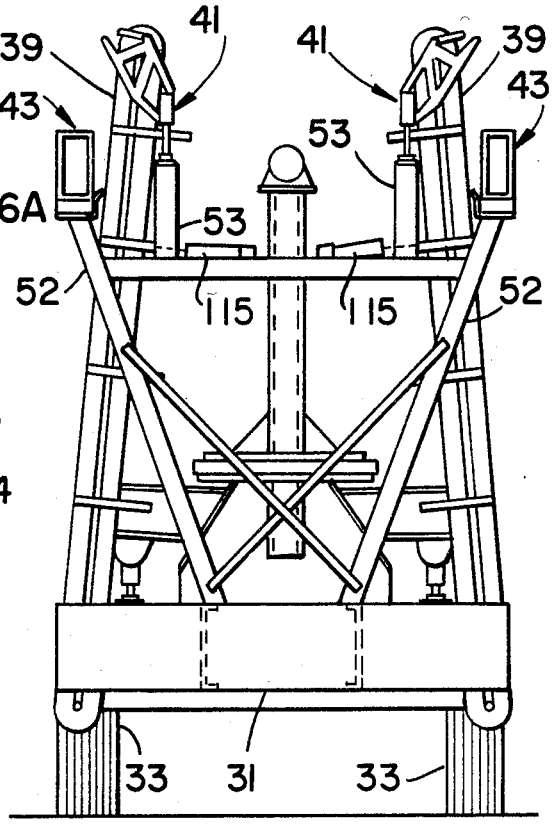
FIG. 4 is a rear partial elevational view partially in section showing the well servicing rig in stored position.

FIGS. 2 and 3 illustrate the well servicing rig of the present invention in its storage position for transport from location to location. As illustrated particularly in FIG. 2, the derrick 43 is pivoted about pivot 51 and folded back over the top of the vehicle 31 and supported, as shown in FIG. 4, on inverted A-frame legs 52. The pipe rack arms 37 are folded to be parallel to the axis of the vehicle and jib cranes 38 are centralized with the vehicle and folded at their joint to be supported within the vehicle. Conveyors 39 are tilted toward the interior of the vehicle and positioned inside of the derrick masts 43. Transfer arms 41 are positioned in their horizontal position and supported on supports 53. The traveling block 46 and elevator 48 are stored adjacent to the operator cab 34 at the forward end of the vehicle. As shown in FIG. 3, the automatic pipe manipulator 45 is stored inside of the derrick legs 43.

By referring to FIGS. 1–5 and comparing the positions of the equipment in the stored and operating positions, it should be apparent that all of the apparatus needed for servicing and operating a well is included in the mobile well servicing rig. As illustrated particularly in FIG. 2, the hydraulic lifting mechanism 54 operating between the frame of the vehicle and the legs of the derrick 43 may be actuated to expand the piston systems to rotate the legs 43 about the pivot 51 to raise the derrick to the position as shown in FIG. 1 above the wellhead 14. When in the elevated position, the legs 43 are tilted slightly forward of vertical, with respect to the forward end of the vehicle, and are maintained in position by the derrick elevator pistons and the cables 40 connected to the vehicle chassis. When in the raised position the automatic pipe manipulating means 45 is in a substantially vertical position, so as to provide true alignment and guidance for well elements into and out of the well head 14.

Figure 5:
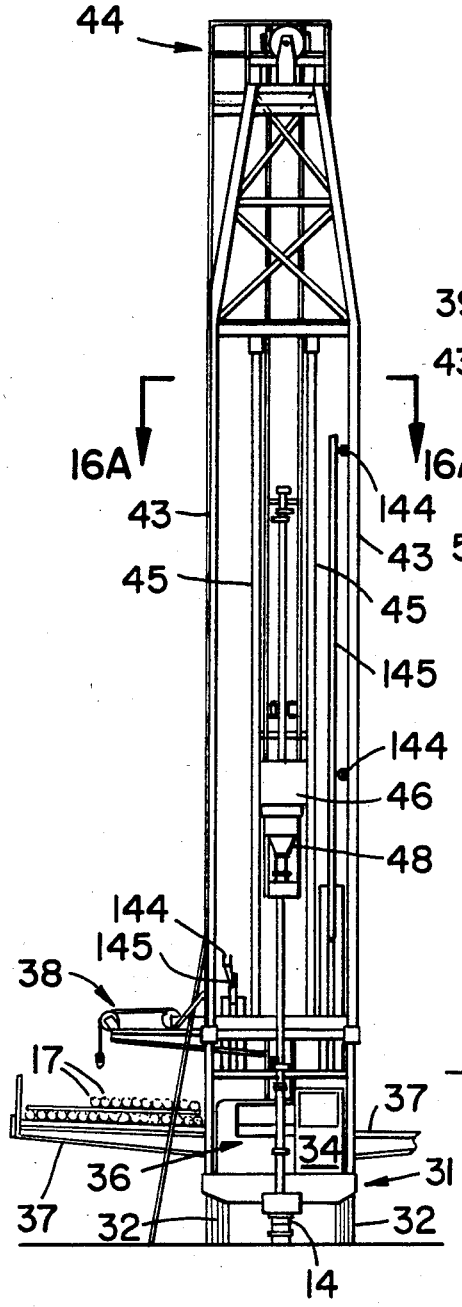
FIG. 5 is a front elevational view of the well servicing rig in operational position with respect to a well head.
Figure 6:
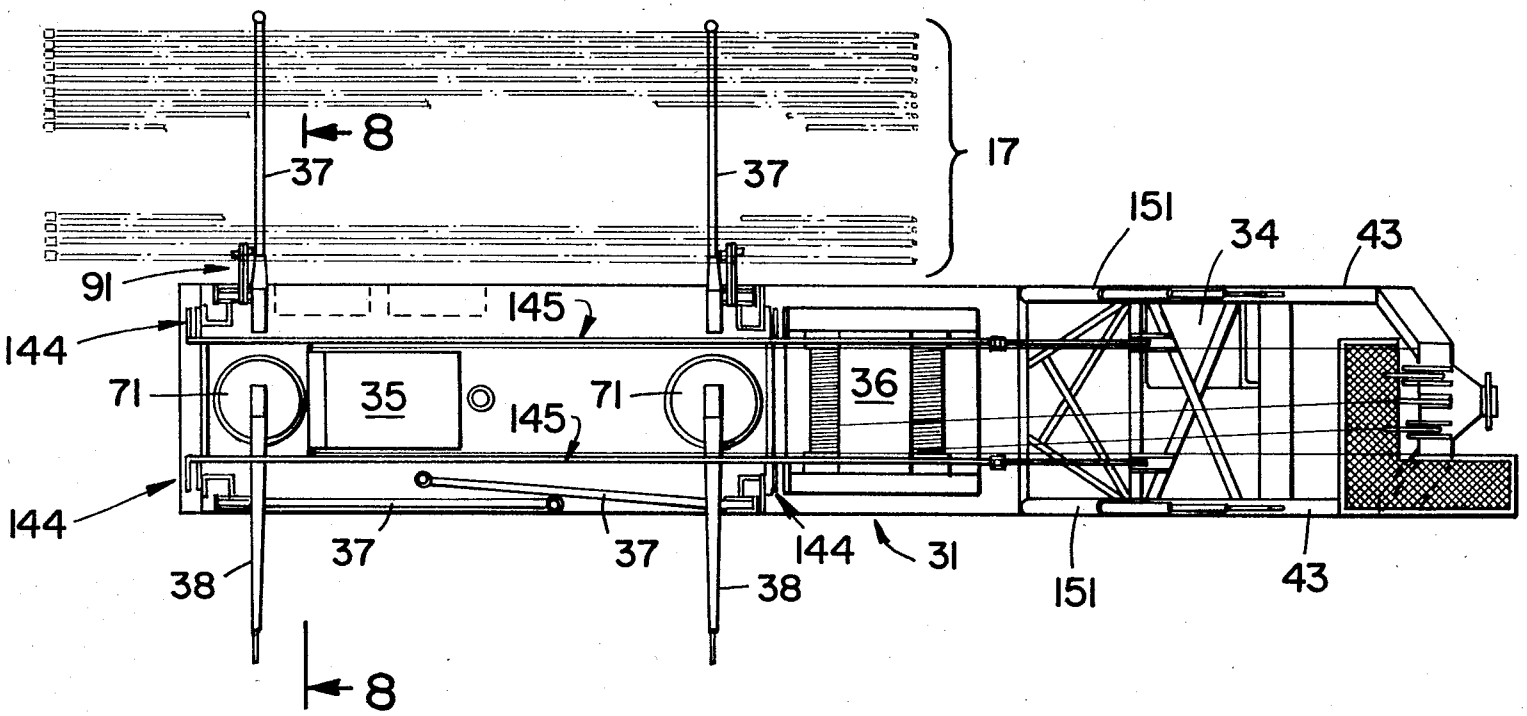
FIG. 6 is a top plan view of the well servicing rig having particular reference to the pipe storage portion of the rig.

Referring now to FIGS. 1, 5 and 6, wherein the first of several coordinated portions of the apparatus of the present invention is shown, a possible first function that the fully contained drilling rig performs is the provision of storage space for well elements. As is seen in FIGS. 5 and 6, each side of the rig 31 is provided with fold-out pipe rack arms 37. A pair of pipe rack arms are provided on each side so that well elements may be stored parallel to the axis of the chassis of the vehicle on both sides in a position for access from the rig. As shown in FIG. 6, the pipe rack arms on the left side of the vehicle (facing forward) are shown in their extended position perpendicular to the vehicle, and on the right side of the vehicle, the pipe rack arms are shown in their stored position within the confines of the rig. Further details of the mounting of the pipe rack arms are shown in FIGS. 7, 8 and 9.

Figure 8:
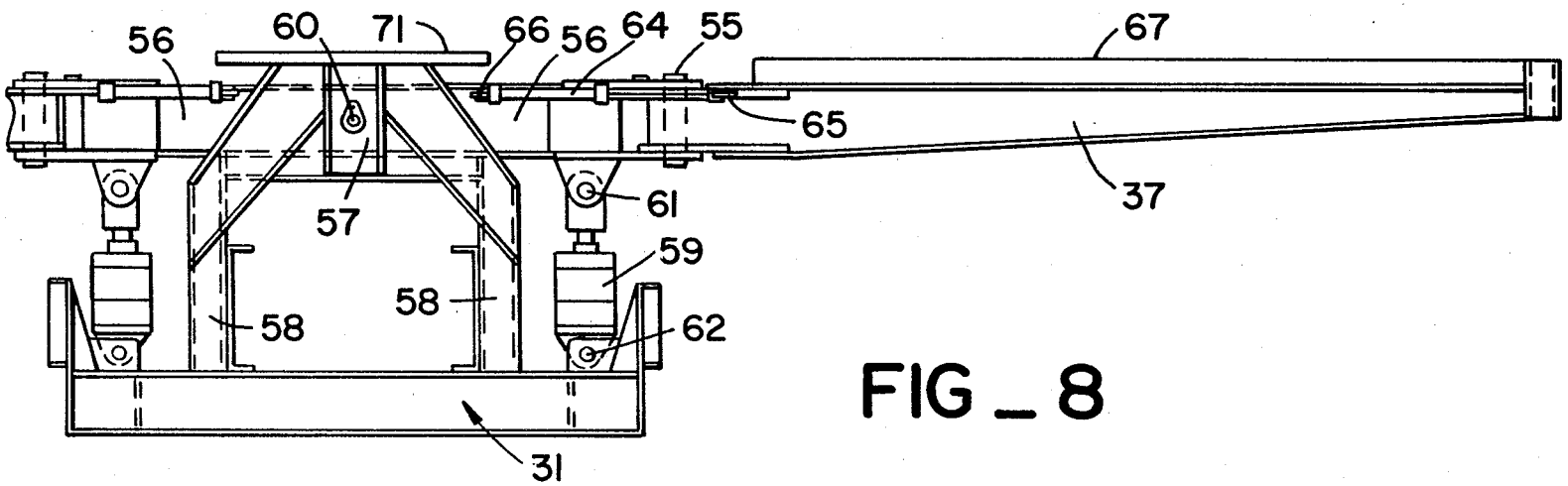
FIG. 8 is a partial sectional view taken generally along the lines 8—8 of FIG. 6.

As illustrated in FIG. 8, the pipe rack arms are journaled on vertical pins 55 supported on a frame member 56 journaled at the center of the rig on frame 57 supported on suitable framing legs 58 secured to the chassis of the rig. Inboard of the journal 55 and attached to the underside of the framing members 56 is a hydraulic operator 59 suitably pinned at 61 and 62 to the frame member 56 and the chassis 31, respectively. The hydraulic operator is operable to raise and/or lower the pipe rack arms about their pivot on frame 57 so that the arms slope either toward, away from, or are level with respect to the chassis 31.

Figure 7:
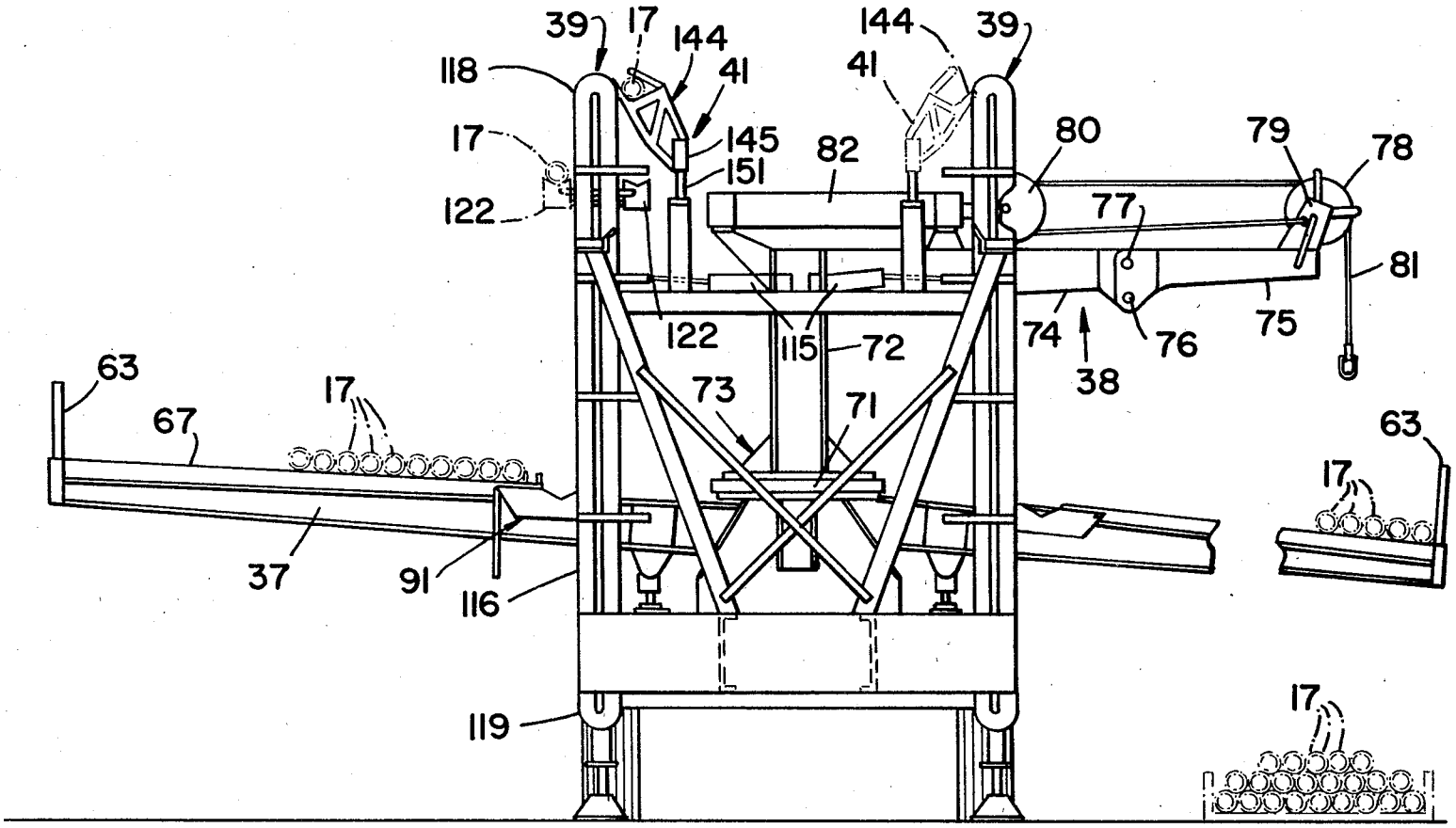
FIG. 7 is a rear elevational view of the well servicing rig illustrating the pipe storage, conveying and transfer means.

Referring particularly to FIG. 7 where one of the pipe racks 37 is illustrated, it can be seen that the slope of the rack is such that the well elements 17 roll along the upper surface of the pipe rack toward the inboard portion of the rig. On the opposite side of the rig a pipe rack arm is shown in phantom with a slope away from the rig so that well elements 17 are rolled away from the rig and are stored against a stop pin 63 fixed to the outboard side.

Figure 9:
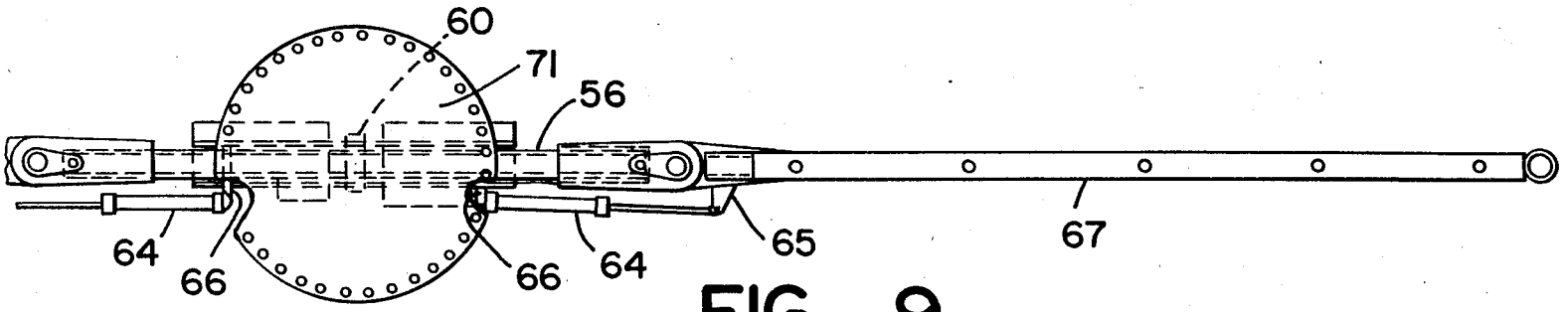
FIG. 9 is a top plan view of the pipe rack details of FIG. 8.

As shown in FIGS. 8 and 9, hydraulic operators 64 are provided for each of the pipe rack arms to provide the operating force to move the arms to the extended position outboard of the rig. The hydraulic operators 64 operate between a bracket 65 on the pipe rack arms and a bracket 66 mounted to the frame member 56.

As shown in FIG. 7, above the pipe rack and pivoted on a central rotary plate 71 are mounted a pair of jib cranes 38. The vertical support for the jib crane in a channel shaft 72 including a journaling arrangement 73 for rotatably mounting the shaft on the rotary plate 71. The horizontal arm of the jib crane includes a member 74 fixed to the vertical shaft 72 and extension 75 hinged at 76 and pinned at 77 onto the member 74. The outboard side of the extension 75 carries a sheave 78 pivoted on a bracket 79 and a cable 81 passes over the sheave and is guided over a movable sheave 80 moved by operator 82 mounted on the upper surface of the horizontal member 74. It should be noted that the jib crane is rotatable about vertical shaft 72 so as to position the cable 81 for use to pick up a supply of well elements 17 on the ground beside the rig or on the bed of a delivery truck. The cable and crane may be used to lift the well elements while the pipe rack 37 is positioned parallel to the rig and, while the cable holds the well elements above the position of the pipe rack, the racks may be extended to be perpendicular to the rig and the well elements may be then placed on the pipe rack. In reverse operations elements may be withdrawn from the pipe rack by being lifted with the cable and placed on a delivery truck or on the ground adjacent to the rig. The jib cranes 38 are mounted above the arms of the pipe rack and positioned so that they may be rotated to either side of the rig to provide lifting and servicing operations to pipe racks on either side. The construction with the extension 75 and its hinged and pinned relationship permits the jib cranes to be stored in the positions illustrated in FIG. 2 when the rig is collapsed to its transport position.

Figure 10:
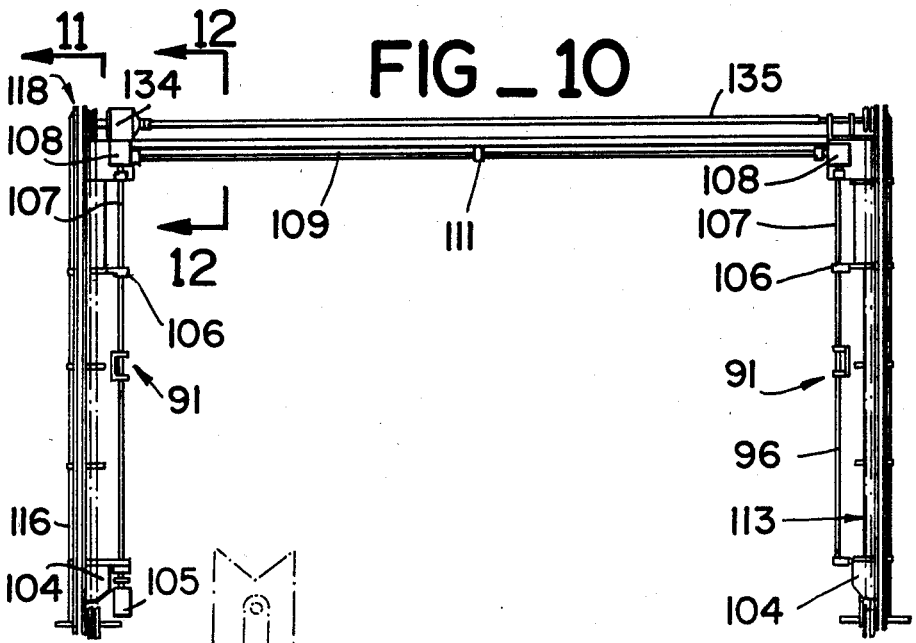
FIG. 10 is a side elevational view of the pipe conveyor portion of the well servicing rig.
Figure 10A:
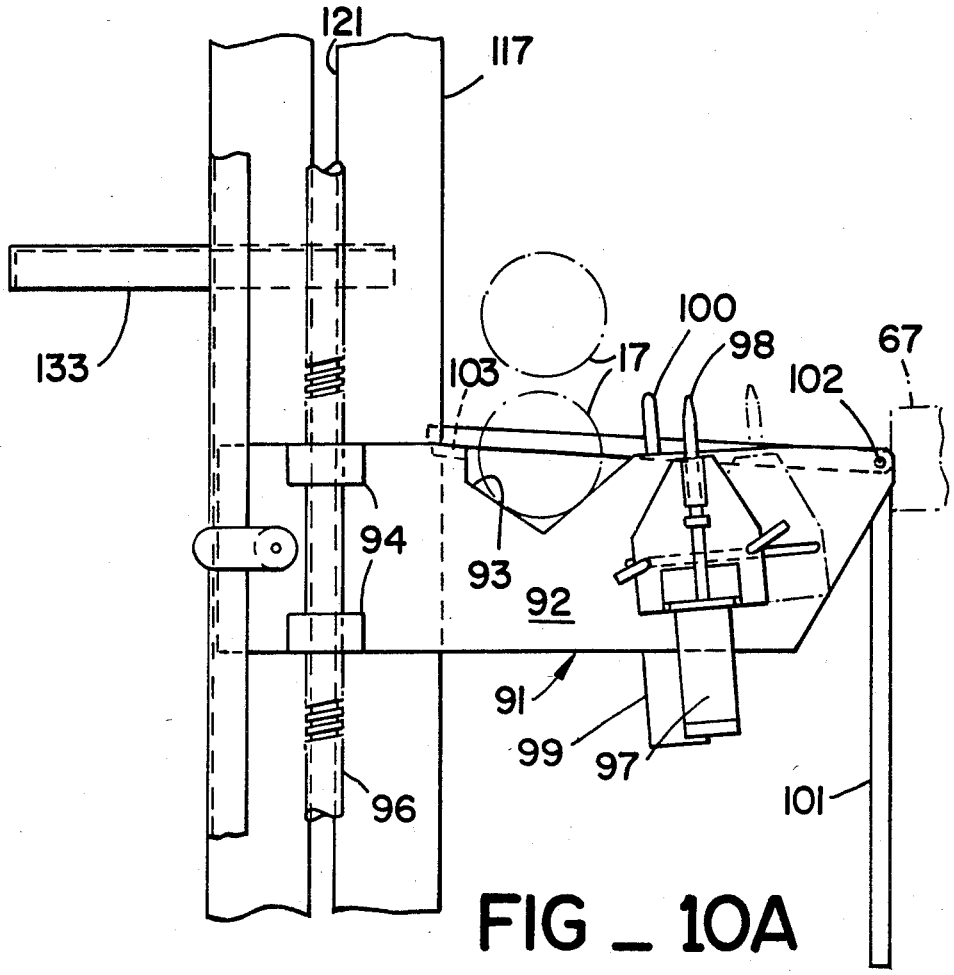
FIG. 10A is a partial elevational view of the conveyor means of FIG. 10 and illustrating the indexing means and its associated gates.
Figure 10B:
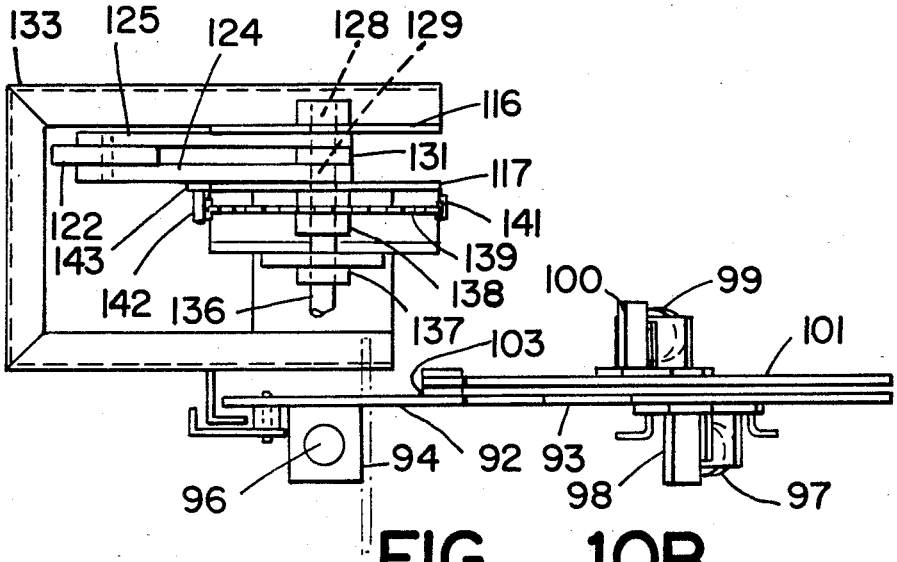
FIG. 10D is a top view of FIG. 10A partially in section.
Figures 31, 34, 35, 36:
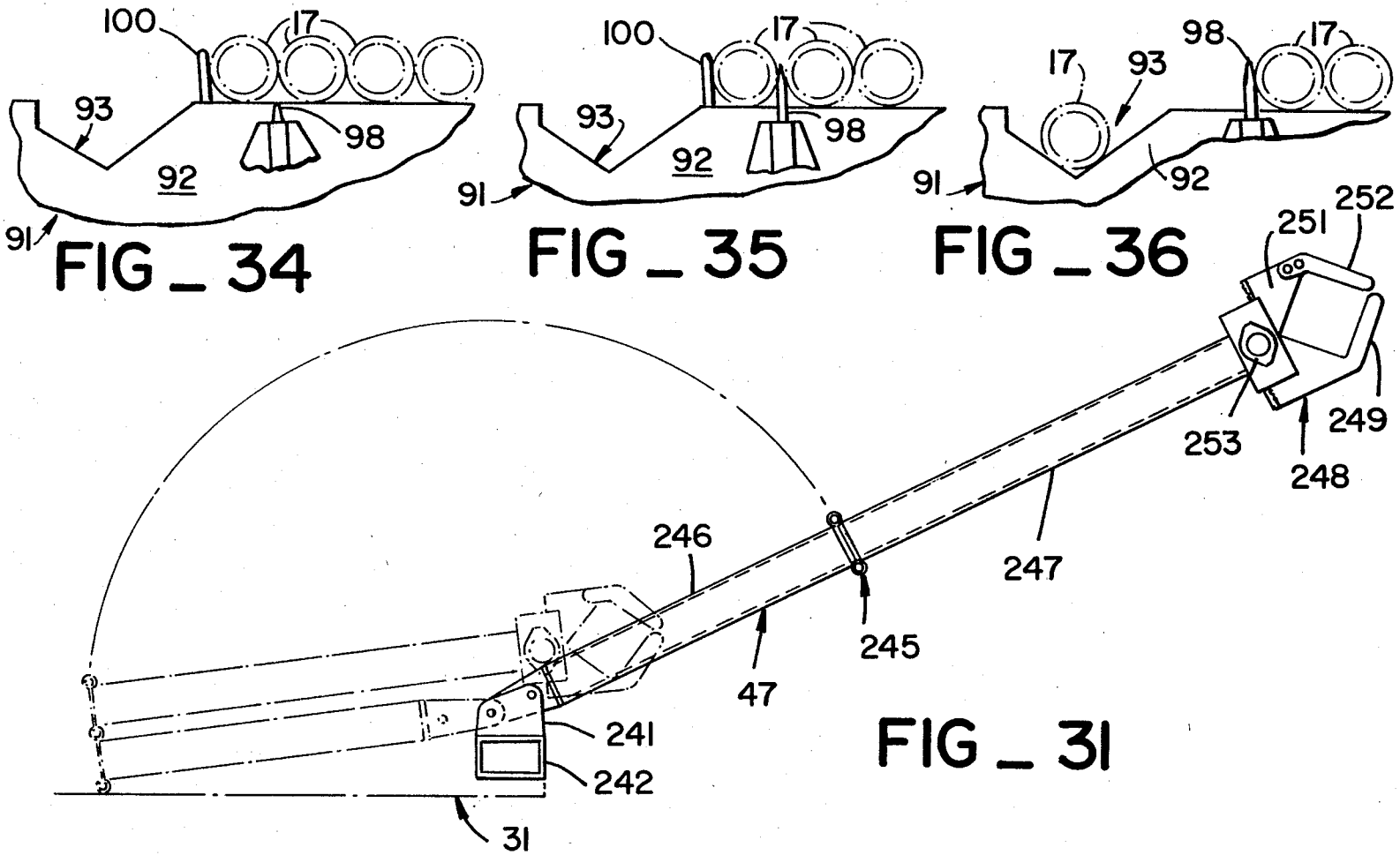
FIG. 31 is a top plan view of the centralizer of the present invention.
FIGS. 34, 35 and 36 are sequential views showing the operation of the gate and indexer of the pipe conveying means shown also in FIGS. 10A and 10B.

For the purpose of delivering well elements to the transfer arms 41 and eventually to the automatic pipe manipulator 45 for running into the well, it is essential that individual well elements 17 be indexed into a fixed position where other portions of the well servicing rig may cooperate with the well elements. The pipe rack arms 37 are provided with an upper member 67 preferably wood and slightly shorter than the movable portion of the pipe rack arms. As shown in FIG. 7 an indexer 91 is locatable in a position with respect to the pipe rack arms and slightly above or below, depending respectively, upon whether well elements are running out of or into the well. Details of the indexer are shown in FIGS. 10A and 10B and the operation of the indexer is shown in FIGS. 34, 35 and 36 where the indexer is shown to constitute a body portion 92 having an indexing groove 93 cut into its upper surface to provide an alignment location for well elements 17 shown as phantom indications of tubing or rods. The indexer has a pair of threaded travelers 94 fixed to its outer surface in a position to cooperate with a worm shaft 96 so that rotation of the worm shaft moves the indexer up and down along the worm to accomplish positioning of the indexer with respect to the pipe rack arms 37. As shown in FIG. 6 the indexer 91 is adjacent to the pipe rack arms 37 with a portion thereof extending outwardly from the drill rig to a position for cooperation with the well elements.

The indexer 91 is further provided with gating means 97 including a retractable barrier 98 for controlling movement of well elements into the index groove of the indexer. A second gating means 99 including a retractable barrier 100 controls the passage of a well element into the indexing groove. The two gating means 97 and 99 are needed for running well elements into the well when the control and sequencing of well element movements will be seen as an integral part of the present invention. As shown in FIGS. 34, 35 and 36, well elements which were supported on the pipe rack arms 37 drop onto the body portion 92 of indexer 91 and stop against indexer gate 100. When the equipment is ready to advance a well element 17, gate 98 is extended to hold the elements and separate on element from the row as shown in FIG. 35. Gate 100 is then withdrawn and element 17 rolls into the indexing groove 93 as shown in FIG. 36. Gate 100 is then extended and gate 98 withdrawn to index the next element for use as shown in FIG. 34. The indexer is further provided with a blocking bar 101 pinned at 102 to the body portion 92 and rotatable to a position to cooperate with an ear 103 on the inboard side of the body portion. When rotated to the position for cooperation with the ear 103, as shown phantom in FIG. 10A, the blocking bar 101 excludes well elements from the indexer so that elements will ride on the upper surface of the blocking bar and be transported down the slope to the pipe rack arms 37.

It should be apparent that in the two operating positions of the indexer, i.e. the position for indexing well elements for running into the well and in the position for guiding well elements when running out of the well, the indexer may be at any position along the worm 96 depending on the height of the elements stored on the pipe rack arms 37. The gates 97 and 99 will control entry of elements to the indexer and blocking bar 101 will roll elements onto the stored elements or the pipe rack arms.

Figure 12:
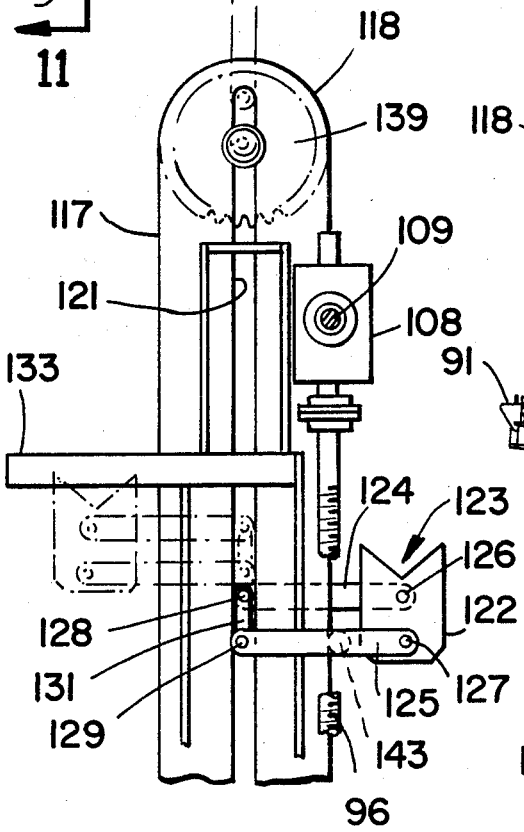
FIG. 12 is a partial sectional view taken generally along the lines 12—12 of FIG. 10.
Figure 11:
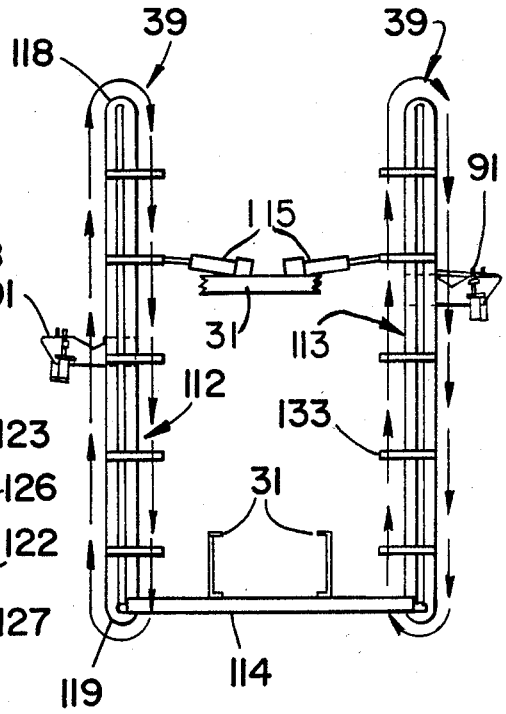
FIG. 11 is a sectional view taken generally along the lines 11-11 of FIG. 10.

There are four indexers associated with the mobile well servicing rig of the present invention, one for each of the pipe rack arms. The two indexers on the same side of the rig are positioned in the same elevation regardless of whether they are receiving or passing elements. The worm gear providing the movement and support for the indexers is supported on the conveying means 39. Referring now to FIGS. 10, 11 and 12, the worm gear 96 is shown supported on a mounting plate 104 providing both support and a bearing journal for the worm gear. The mounting plate 104 is affixed to the frame of the conveying means 39. At one side of the conveying means a hydraulic motor 105 is supported on the mounting plate 104 to provide the necessary rotary motion of the worm gear 96. An upper shaft guide 106 is provided at each side of the conveying means and a shaft 107 is supported in the guide in a relationship to carry drive motion from the worm 96. A pair of 90° angle gear boxes 108 change the direction of the drive from the worm 96 to shaft 109 passing horizontally across the upper surface of the conveying means with support provided at a bearing journal 111. With the mechanism just described rotation of the motor 105 drives worm 96 at the left hand side of FIG. 10 to cause movement of indexer 91 up or down the conveying means. Rotation of shaft 96 is transferred to shaft 106 through gear box 108 and shaft 109 to gear box 108 at the right hand side of FIG. 10 and through shaft 107 to worm 96 at the right hand side. The drive and gear boxes are designed to cause indexers 91 on both sides of the conveyor to move simultaneously and in the same direction.

With the mechanisms just described the well elements which have previously been placed on the pipe rack arms are now positioned in an indexing location when running into the well so that additional mechanism of the well servicing rig may always find the well elements in exactly the same location. Likewise, when well elements are being run out of the well the indexing mechanism is in a place to unload those well elements onto the pipe rack for further disposition. As may be seen in FIG. 11, the indexer 91 on the left hand side of the figure is located in a position for running well elements into the well. The indexer 91 shown on the right hand side of the figure is in its position for running well elements out of the well.

As previously described the mounting plate 104 is supported on a portion of the vertical support members 112 and 113 of the pipe conveying means 39. The pipe conveying means 39 is duplicated at each side of the well servicing rig; for the purposes of description here, only one side of the conveying means will be described. The purpose of the pipe conveying means 39, when running well elements into the well, is to pick the well elements from the indexer 91 and transport them to a position where they may be placed into the transfer arms 41; or in the case of running well elements out of the well to transfer well elements from the transfer arms 41 into cooperation with the indexing means 91 and onto the pipe rack arms 37. As illustrated in FIGS. 7, 11 and 12, when the rig is in the operational position, the pipe conveying means is aligned perpendicular to the leveled chassis of the well servicing rig. The pipe conveying means are supported on a bar 114 fixed to the underside of the chassis of the vehicle 31. Each of the vertical support members is pivoted on a axle suitably connected to the bar 114 to permit the pipe conveyers to be rotated from the operational position as shown in FIGS. 7 and 11 to the storage position as shown in FIG. 4. Hydraulic actuators 115 operating between the chassis of the vehicle 31 and the vertical support members are adapted for moving the conveyor means about their pivot on bar 114.

Each of the vertical support members constitutes a pair of guide plates 116 and 117 that are elongated, have a rotary surface at each end as at 118 and 119, and an internal slot 121. The guide plates 116 and 117 and their rotary surfaces 118 and 119 and the slot 121 are designed to provide operating guides for elements that are adapted to provide for a continuous orientation for a lifter jaw 122 associated with each of the vertical support members of the conveying means.

As shown in FIG. 12 the lifter jaw 122 is provided with an indexing slot at 123. The lifter jaw is designed and located to be in alignment with the indexing groove 93 of the indexer 91. As the lifter jaw moves in a upward direction passing the indexer 91 it is adapted to pick a well element out of the indexer and carry it along the conveying means. The lifter jaw is maintained in a vertical orientation by having a pair of arms 124 and 125 affixed at pivoted pins 126 and 127 on the lifter jaw and positioned between the elongated guide plates 116 and 117 with a pair of pins 128 and 129. A link 131 spaces the arms 124 and 125 within slot 121 and suitable spacer means 132 are provided for each arm to maintain proper alignment between the guide plates 116 and 117. The guide plates 116 and 117 are supported in fixed position by a series of U-shaped brace members 133 spaced vertically along the conveyor means. The interior of the U-shape of the brace is adapted to accommodate the lifter jaws and the bight portion of the U-shape is only on the interior portion of the conveying means where it will not interfere with well elements.

The driving force to the lifter jaws is provided by a hydraulic motor 134 mounted, as shown in FIG. 10, adjacent to the vertical support member 112 and connected by an elongated shaft 135 to a duplicate set of drive mechanisms at vertical support member 113. Motor 134 is also connected to a drive shaft 136 and, through bearings 137 mounted on and passing through brace 133 connect to the hub 138 of a sprocket 139. Sprocket 139 cooperates with a chain link belt 141. Secured to the chain link belt by suitable means is a draw pin 142 which is attached to arm 124 carrying the lifter jaw 122 and a roller 143 in a position to cooperate with the rotary surfaces 118 or 119 of the guide plates 116 or 117, respectively.

Rotation of shaft 136 and 135 by motor 134 causes rotation of sprocket 139 on the inside portions of each of the vertical support members 112 and 113 of the pipe conveyor means 39. That rotation causes the sprocket and its connection to draw pin 142 to carry the lifter jaw in a rotary but always vertically oriented path around the vertical support members. As shown in FIGS. 11 and 12, the path of the lifter jaws carries them into alignment with the indexing slot of the indexer 91 and, the design of the drive mechanism always keeps the lifter jaw oriented in an upward direction. The arrows shown in FIG. 11, left side, illustrate the direction of the rotation of the lifter jaws for transporting well elements into the well, and the arrows, right side, illustrate the rotation in the opposite direction for removal of well elements from the well.

Figure 13:
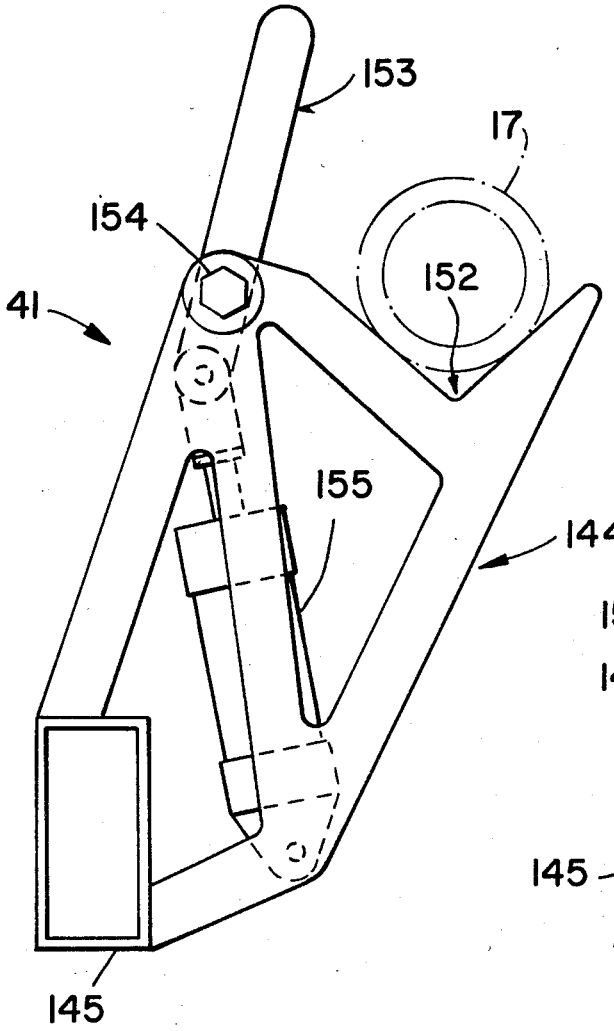
FIG. 13 is a detailed elevational view of the transfer arm hands.
Figure 14:
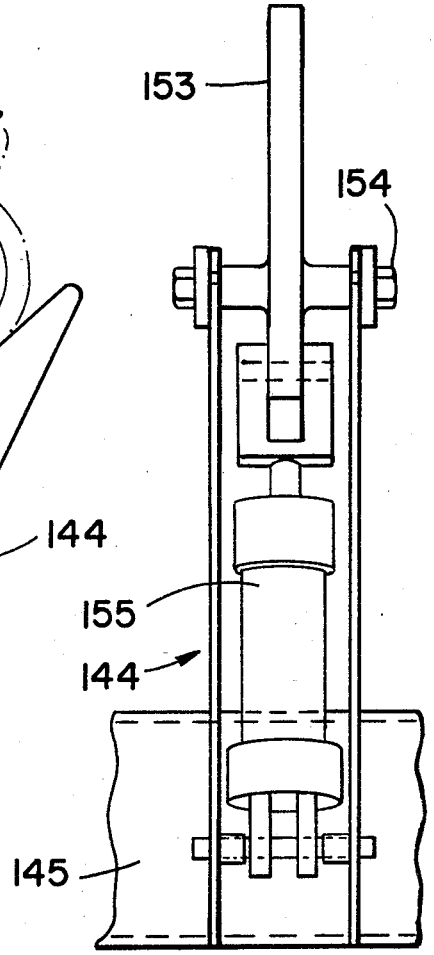
FIG. 14 is a side elevational view of FIG. 13.

In FIG. 7, at the left hand side of the conveyor 39 and at the left side of the rig, a lifter jaw 122 is shown, in phantom, carrying a well element 117 in its path up the conveyor 39. On the right hand side of that same conveyor, the lifter jaw 122 is shown in its position after it has deposited the well element 117 into the jaws of a hand of the transfer arm 41. FIG. 13 illustrates the jaw 144 mounted to an arm 145. The arm 145, as shown in FIG. 1, is an elongated member which carries two jaws 144 and moves between a position cooperating with the conveyor 39 to a position cooperating with the automatic pipe manipulator 45. FIG. 1 also shows the transfer arm, in phantom, in its position halfway between the conveyor means and the automatic pipe manipulator. The transfer arm is supported on a portion of the frame of the rig by a pair of arms 146 and 147 both of which are pivoted at 148 on frame 149 of the rig. A lifting mechanism, comprising a hydraulic cylinder 151, expands and contracts to lift the transfer arm from its cooperating position with the conveyor to its position for cooperation with the automatic pipe manipulator. As shown in FIG. 7, the arm 145 rests on a support 151 attached to a portion of the frame of the rig. When resting on the support 151 the transfer arm 41 is in position to receive pipe or to transfer pipe to the conveyor means 39. As shown in FIG. 13, the jaw 144 is fabricated to provide an indexing configuration at 152. The orientation of the transfer arm and particularly the indexing configuration of the jaw 144 is such that it is in alignment with the indexing slot of the lifter jaws as they are rotated around the conveying means. A gripper pin 153 is pivoted at 154 and an extension beyond the pivot cooperates with the hydraulic operator 155 to cloe the pin about a well element, as for instance the tubing piece shown in FIG. 13.

There are two transfer arms 41, one at each side of the rig and each transfer arm is equipped with a pair of jaws 144. Each transfer arm is equipped with its separate arms 146 and 147 and its hydraulic operator 151. The purpose of the transfer arms 41 is to transfer the well elements from a horizontal position above the well servicing rig to a vertical position in cooperation with the automatic pipe manipulator (APM) 45 adjacent to the center line of the wellbore.

Figure 16:
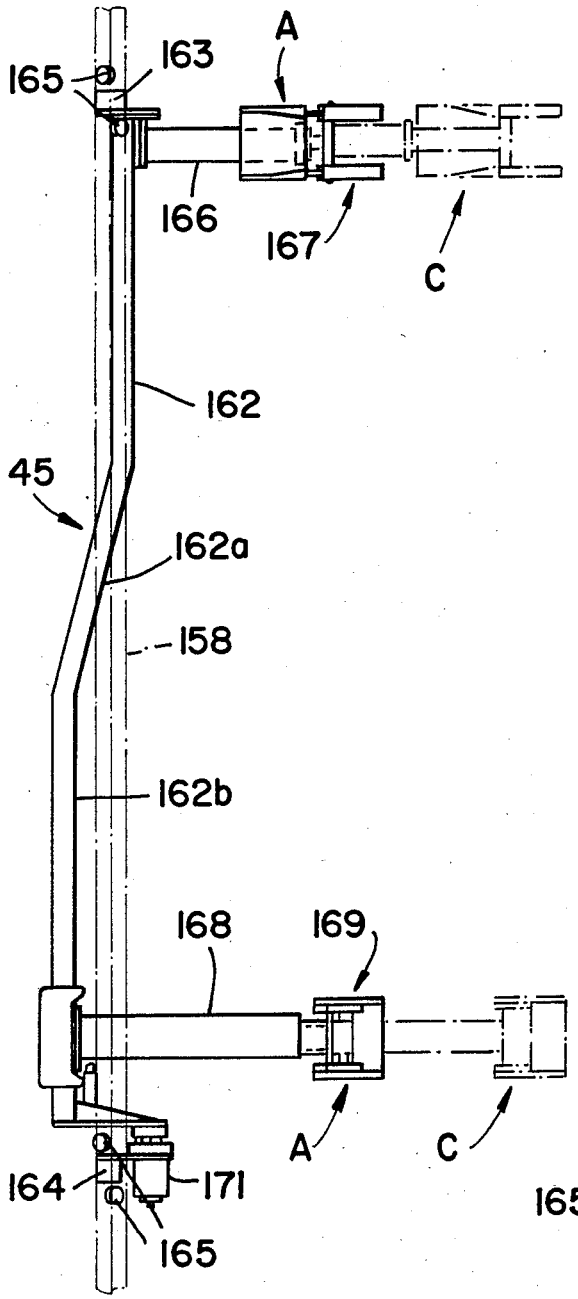
FIG. 16 is a side elevational view of FIG. 15 showing the operational positions of the automatic pipe manipulator ends.
Figure 15:
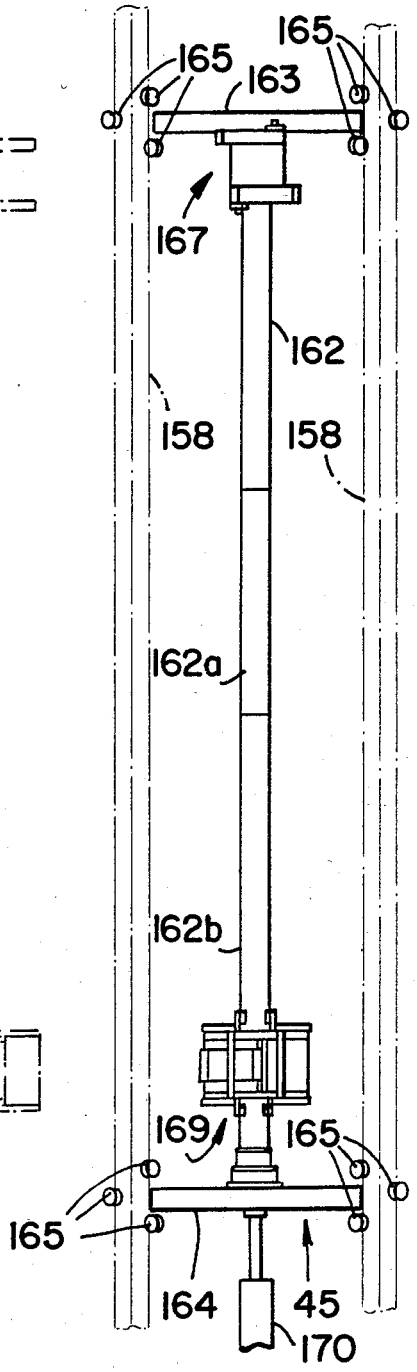
FIG. 15 is a front elevational view of the automatic pipe manipulator of the present invention.
Figure 16A:
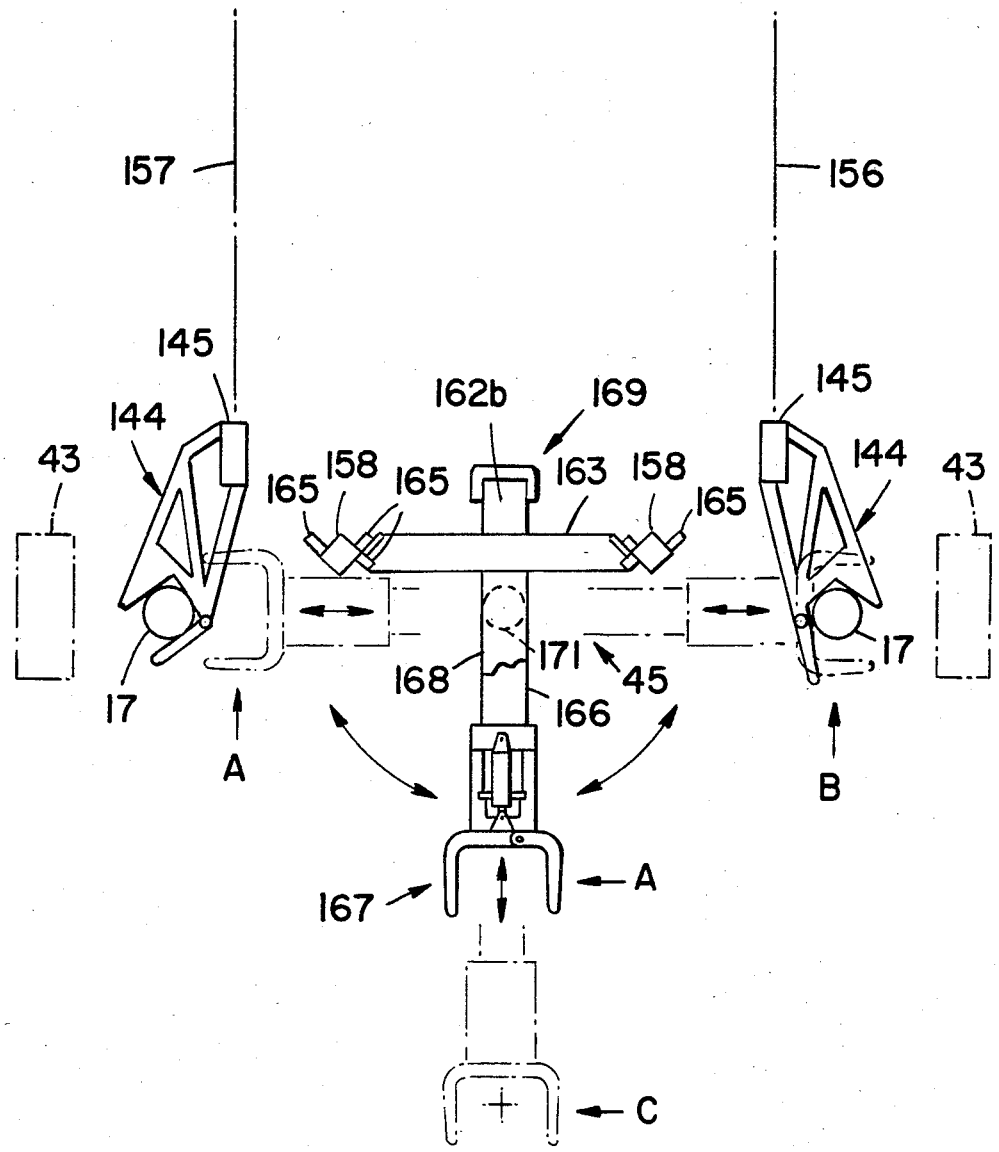
FIG. 16A is a sectional view taken along the lines 16A—16A of FIG. 5, showing several cooperating positions of the elements of the invention.

As shown in FIGS. 1, 5, 15 and 16, the arm 145 and the jaws 144 of the transfer arm operate in planes that are aligned between the legs of the derrick 43. When the transfer arm is in the upright, vertical position, the well element in its jaws is positioned for transfer to the automatic pipe manipulator jaws. FIGS. 15 and 16 illustrate the automatic pipe manipulator in front and side elevation. With reference to FIG. 16A, representing a top plan view of the movements of the automatic pipe manipulator, planes represented by dotted lines 156 and 157 between the legs of derrick 43 represent the operating planes of the transfer arms in tilting horizontal to vertical. The automatic pipe manipulator operates between the operating plane of the transfer arms and within the derrick legs. The automatic pipe manipulator constitutes a pair of guides 158 fixed at the upper end by offset braces 159 and at the bottom end to the legs of derrick 43 adjacent to the pivot 161 for the derrick. Mounting of the APM guides to the derrick is such that when the derrick is in it upright position, the derrick will be leaning forward in respect to the well servicing rig while the guides 158 will be vertical and offset from the center line of the well being serviced. Operating between the guides is a support 162 pivoted in horizontal braces 163 and 164 with the braces supported by rollers 165 pressed against the inside and outside surfaces of the guides 158 and 150. The support 162 is offset at **162*a* to provide a lower portion 162*b* offset from the upper portion of 162**. The purpose of the offset will become more apparent with further description of the elements and operation of the rig.

Fixed at the upper end of the support 162 is an upper APM arm 166 supporting an upper APM hand 167. Fixed to the lower end **162*b* of this support, is a lower APM arm 168 supporting a lower APM hand 169. Arms 166 and 168 are hydraulically operated pistons that support the hands 167 and 169 respectively and function to move the hands from solid alignment against the body of the arm to an extended position, a fixed distance away from their support on the arms 166 and 168. The extended positions are shown in phantom FIG. 16 and, in rotated position, in FIG. 15**.

The pivot of support 162 on the horizontal braces 163 and 164 is slightly forward of a plane passing through the guides 158 so that when the support is rotated from a position perpendicular to the plane between the guides to a position parallel of the plane of the guides, the APM arms 166 and 168 will be forward of the guides and in a position of operation in a plane which will pass through the center line of the well element held by the transfer arm when it is in its vertical upright position. A hydraulic motor 171 supported on the lower horizontal brace 164 is connected to the pivot of the support 162 to cause the desired rotation between positions parallel to the guides 158 and perpendicular to the guides 158. A hydraulic piston 170 connected between the horizontal brace 164 and a fixed portion of the rig provides for vertical movement of the APM along the guides 158.

Figure 17:
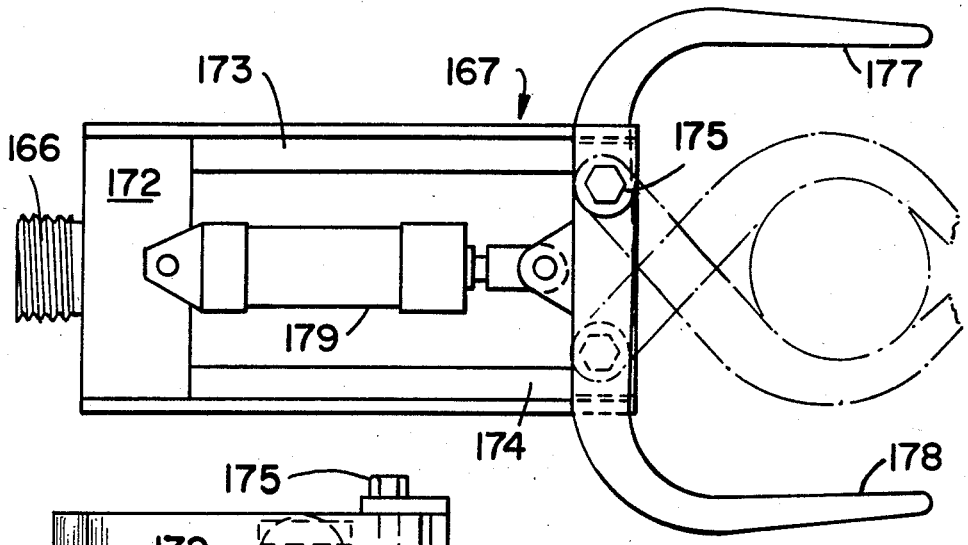
FIGS. 17, 18 and 19 are, respectively, top plan, front elevational and side elevational views of the details of the top hand of the automatic pipe manipulator.
Figure 18:
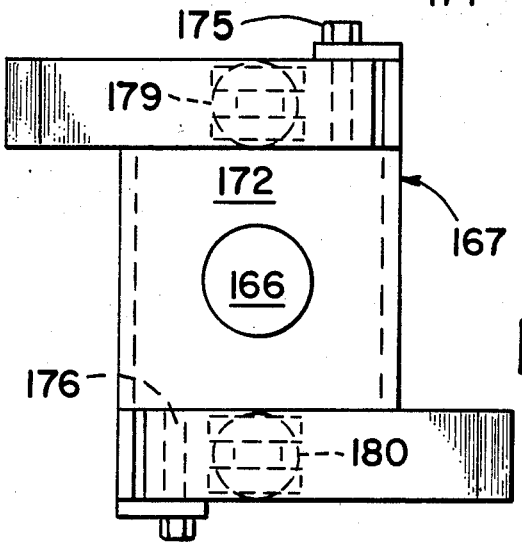
Figure 19:
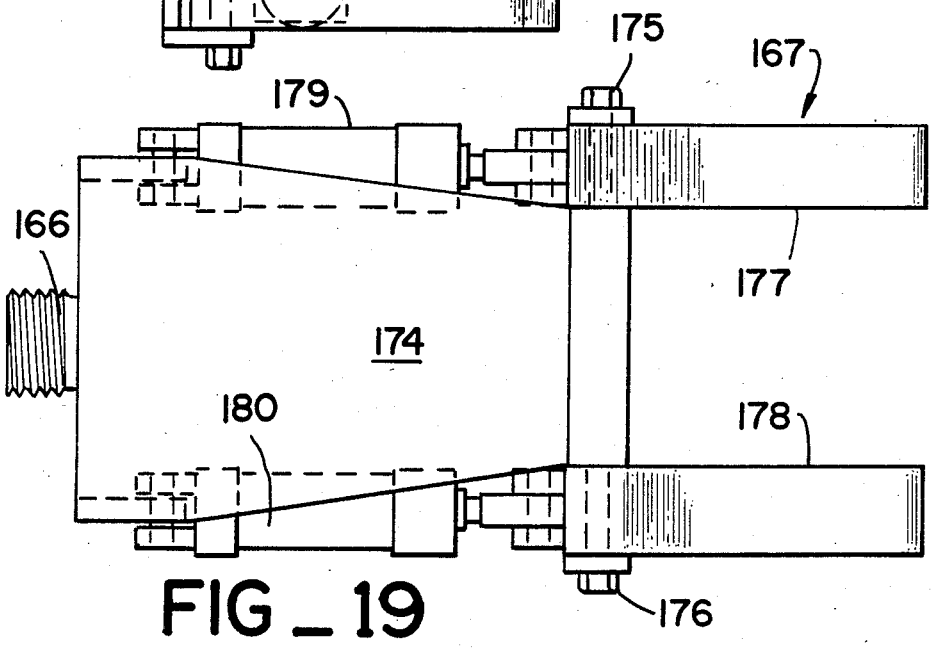

The upper hand 167 is shown in FIGS. 17, 18, and 19. The hand constitutes a body portion 172 having a pair of legs 173 and 174 providing pivots respectively at 175 and 176 for an upper jaw and lower jaw 177 and 178. A pair of hydraulic operators 179 and 180 are fixed to the body portion 172 at one end and are attached to a movable portion of one of the upper or lower jaws in a position adjacent to the pivots to cause the jaws to be enclosed about a well element.

Figure 20:
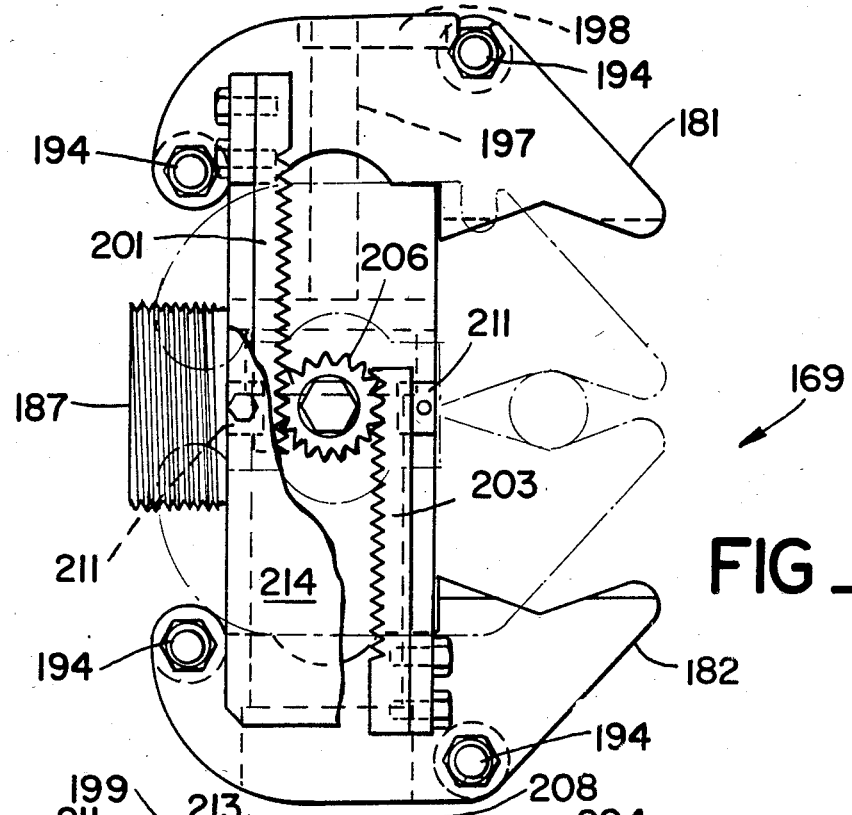
FIGS. 20, 21 and 22 are, respectively, top plan, side elevational and side elevational views of the bottom hand of the automatic pipe manipulator.
Figure 21:
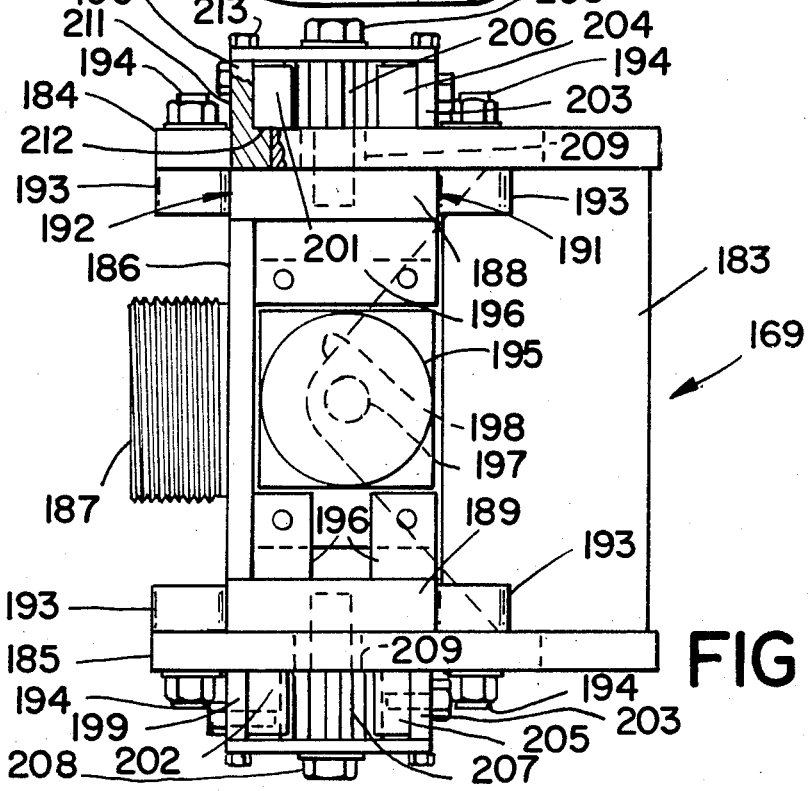
Figure 22:
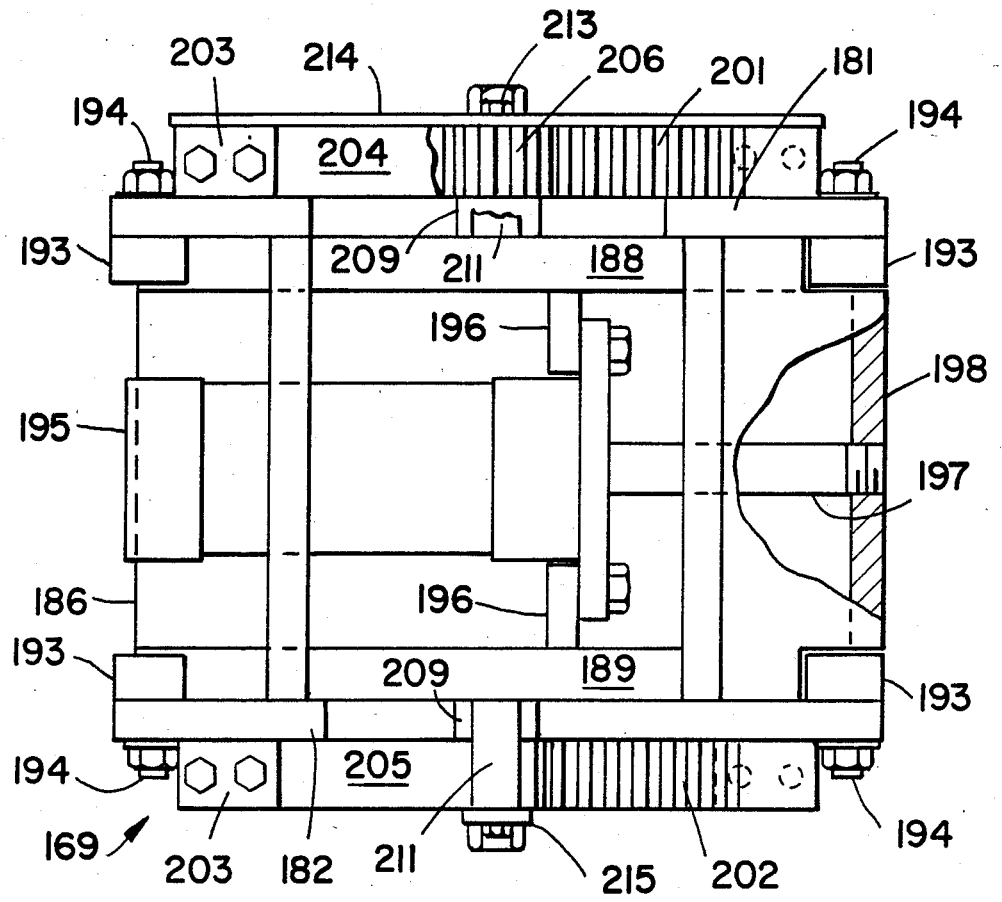
Figure 25:
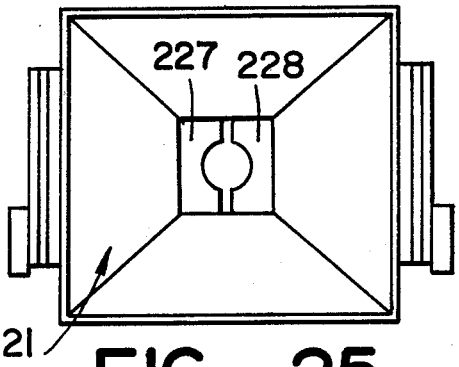
FIG. 25 is a sectional view taken generally along the lines 25—25 of FIG. 23.
Figure 26:
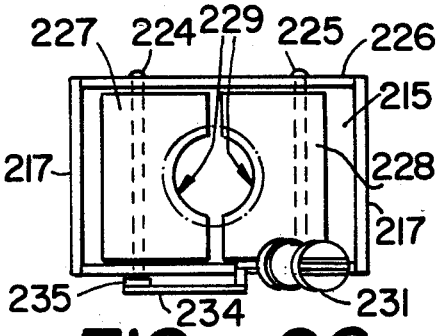
FIG. 26 is a sectional view taken generally along the lines 26—26 of FIG. 23.

On the lower end of the automatic pipe manipulator at the offset lower portion 162*b*, the lower APM hand is mounted on lower APM arm 168. As shown in FIGS. 20, 21, and 22, the lower APM hand comprises a pair of jaws 181 and 182 adapted to be moved horizontally toward and away from each other so as to firmly grasp well elements both in transporting them in and out of the alignment with the wellbore and into and out of engagement with the transfer arms 41. The jaws 181 and 182, which are substantially duplicate of each other, have a generally U-shape wherein the bight of the U forms the grasping portion of the jaws as at 183 in FIG. 21 and a pair of legs 184 and 185. The legs surround a generally U shaped track member 186 which its bight portion welded to a threaded means 187 adapted for mounting the lower APM hand 169 to lower APM arm 168. The legs 188 and 189 provide track surfaces at their outer edges, as for example at 191 and 192, on leg 138. Cooperating with the track surfaces are cams 193 rotatably mounted on journal bolts 194 passing through the jaws 181 and 182. The cooperation between the cams 193 and track surfaces 191 and 192 provide for lateral horizontal movement of the jaws with respect to the vertical center line of the lower APM hand 169.

Uniform and equal movement of the two jaws, 181 and 182 is accomplished by actuation of a hydraulic operator 195 mounted to ears 196 on the inside surface of the legs 188 and 189 of track 186. The rod 197 of the hydraulic operator 195 is threaded into and ear 198 on jaw 181, as shown in FIG. 20, so that actuation of the operator 195 causing the rod to contract into the cylinder causes jaw 181 to move toward the center line of the lower APM hand.

Welded to the upper and lower surfaces of jaw 181 are a pair of ears 199 to which are mounted an upper and lower rack 201 and 202. Jaw 182 has similar ears 203, positioned inwardly of the jaws with respect to mounting the 187, and upper and lower racks 204 and 205 are suitably mounted to ears 203. Centrally mounted at the top and bottom of the track 186 on legs I88 and 189 are a pair of pinions 206 and 207 on suitable pinion shaft bolts 208. The pinions are provided with a hub at 209 to provide a standoff from the legs 188 and 189 and to place the geared portion of the pinion in cooperation with the racks 201 and 204, respectively, and 202 and 205, respectively.

With the mechanism just described, as the hydraulic operator 195 is actuated and rod 197 is contracted into the operator, the connection to the ear 198 of jaw 181 causes the jaw to move with cams 192 and 193 rolling on track surfaces 191 and 192. That movement causes track 201 to move toward the center of the hand 169 and causes rotation of pinion 206 which transfers its rotary motion to linear motion of the track 203. Movement of rack 203 causes movement of jaw 182 toward the center of the APM hand 169 in the same distance, but reversed direction with respect to jaw 181. The movement of the two jaws toward each other causes any well element between them to be grasped firmly for manipulation in accordance with further operation of well servicing rig.

A pair of support members 211 are mounted to the upper and lower surfaces of the legs 188 and 189 and these members are provided with a shoulder at 212 for interior support of the racks and the outer ends of the support members 211 are provided with a tapped hole into which a machine bolt 213 may be threaded to support a protecting plate 214 at the top of the lower APM hand and a bottom plate 215 at the bottom thereof.

With the mechanisms so far described, the well elements have been, in the case of running pipe into the well, loaded onto the pipe loading rack, transferred by conveyor means to the transfer arms, tilted by the transfer arms to position to cooperate with the automatic pipe manipulator and are now in position to be grasped by the pipe manipulator and put into position in alignment with the well head. FIG. 16A has a composite showing of the several positions of the automatic pipe manipulator 45 and the transfer arms 41 with respect to both the derrick and the center line of the wellbore to which the well elements are to be transferred. As shown in FIG. 16A, the transfer arm 145 with its jaws 144 grasping the well element 17 is between the legs inside of and at the right center of the legs of the derrick 43. The upper APM arm 166 and its hand 167 is shown in solid lines slightly withdrawn from its extended position with respect to the APM guides 158 and, in the phantom position, its fully extended position in alignment with the center line of the well board 14. Also shown in the phantom lines is the position of the upper APM arm 166 and its hand 167 in their contracted position at A and an extended position at B with respect to the jaws 144 of transfer arm 145. There are three positions for the extension of the APM arm 166. The position at A for rotation between the alignment with the transfer arm jaws and the line going through the center line of the wellbore, position B for contact position with well elements held within the transfer arms, and position C for vertical alignment with the center line of the wellbore. The APM is rotated in 90 degree intervals between positions of cooperation with one of the transfer arms 145, 90 degree rotation to position of alignment with the wellbore 14, and a continued rotation of 90 degrees for alignment with the other transfer arm 145. Hydraulic motor 71, as shown in FIG. 16, is energized to produce rotation of the APM support 162 through each of the three positions. Both of the APM arms 166 and 168 are equipped with hydraulic actuators which move the APM hands into the desired positions of A, B, or C. In later description of the positions for the APM arms, position A is referred to as the 30-inch position, position B is the 35-inch position and position C is the 55-inch position.

Beginning with the position of solid lines in FIG. 16A, the upper APM arm 166 is retracted and in alignment with the wellbore, with a well element 17 in the transfer arm 145 as shown, the APM arm 166 may be rotated 90 degrees counter clockwise to a position in alignment with the well element held in jaws 144. The arm 166 is now extended to a position to place the well element within the center of the jaws of the hand 167, and, through mechanisms which will be hereinafter described, the jaws 177 and 178, as seen in FIG. 17, are moved toward each other to grasp the well element. It should be understood that the lower APM arm 168 and his hand 169 are likewise manipulated and upper and lower jaws 181 and 182 are likewise operated to firmly grasp the well elements 17. In the case of the upper APM hand, the jaws 177 and 178 function merely as guides and do not firmly grasp the element. At this time, the automatic control mechanism release the grasp of jaw 144 of the transfer arms and permits the APM arms to assume support of the well element. The APM arms are rotated 90 degrees to the solid position shown in FIG. 15A and, when the control mechanisms advise that the automatic rig is ready to accept an additional well element, the APM arms 168 and 166 are extended to position C in alignment with the center line of the wellbore.

The maneuvering just previously described is duplicated in the event that well elements at the left side of FIG. 16A are to be transferred from the transfer arms to the automatic pipe manipulator and to alignment with the wellbore.

Figure 23:
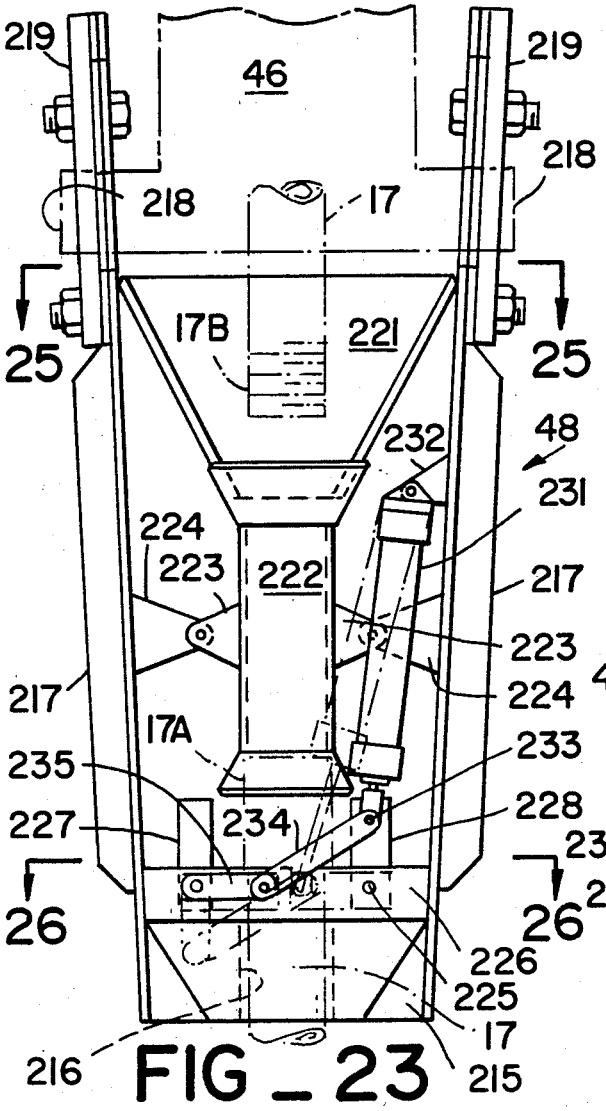
FIGS. 23 and 24 are front and side elevational views of the elevator apparatus of the present invention.
Figure 24:
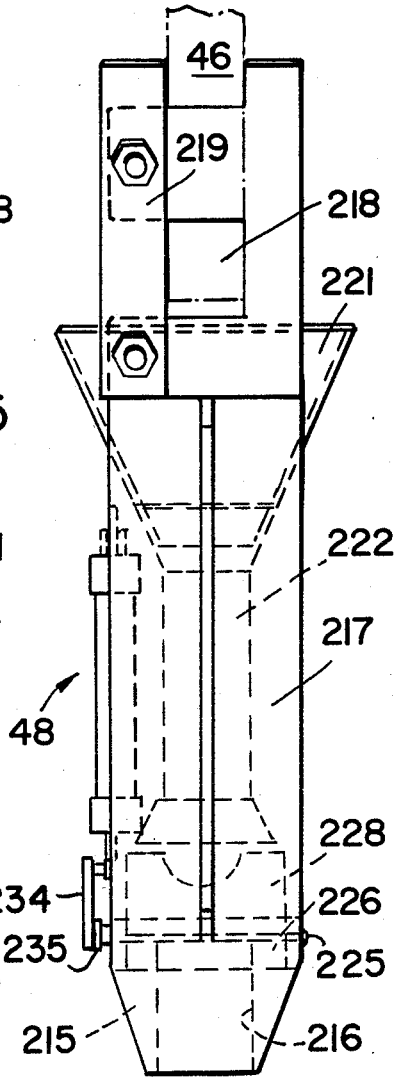

Having transferred well element to the position just described, the well element is now in location for further manipulation with respect to the center line of the wellbore. FIGS. 23, 24, 25, and 26 illustrate the elevator mechanism 48 which is connected by a suitable means to the traveling block 46. The elevator 48 performs the main purpose of grasping the enlarged coller of a well element, as shown in FIG. 23 at 17A, taking support of the well element through cooperation with that coller and permitting the APM hands to release their support of the well element 17. The APM hands are then withdrawn to the position A of FIG. 16A and the well element is lowered into the well through operation of the traveling block 46. The foregoing description is the maneuvering of a well element when it is the first element entering the well. All other subsequent well elements will be transferred by lowering the APM arms until an element comes into contact with the coller of an element already in the well; that lowering is accomplished by moving the APM vertically along the APM guide 158 until the threaded end 178 of a well element has been stabbed into the coller 17A of the well element then being held by the elevator 48. The elevator 48 therefore has two functions: firstly, for raising and lowering well elements and secondly, for providing guidance for connection of well elements when running in.

The elevator 48 is constructed with a solid base portion 215 having a central circular hole 216 therethrough. The base portion is fixed as by welding to a pair of side braces 217. The elevator provides a construction at the upper end for connection to the support ears 218 of the travelling block 46. Braces 219 are adapted to be bolted into place to hold the elevator to the ears 218 of the travelling block. A rectangular funnel 221 is fixed, as by welding, to the inside surfaces of the side braces 217 and a coupling guide 222 is supported below the funnel 221 by the connection of ears 223 on the guide to internal braces 224 on the inside of the side braces 217.

A pair of jaws 227 and 228 are mounted below the coupling guide 222, above the solid base 215 of the elevator, within the interior of the side braces 217, on pins 224 and 225 extending through an upward extension 226 of the base 215. The jaws have semi-circular cut out portions therein at 229 and are complimentary so that the cut-out portions form a circular hole vertically through the jaws.

A pneumatic operator 231 has its fixed end attached to an ear 232 on the interior surface of one of the side braces 217 and its movable end fixed by a pin 233 to a jaw 228. By suitable linkage mechanism such as links 234 and 235, movement of pneumatic operator 231 causing movement of jaw 228 causing similar movement of jaw 227. It should be understood that link 235 is fixed to jaw 227 at pin 224.

When the jaws 227 and 228 are in position shown in phantom in FIG. 23 in contact with the base member 215 they are in position to permit the body of a well element 17 to pass through the elevator but a coller 17A will not pass through the jaws. As further shown in phantom in upper portion of FIG. 23, a threaded end 17B of a well element 17 may be stabbed into the funnel 221, pass through the coupling guide 222 to contact the coupling 17A to then be in position to be threaded into a string extending into the wellbore.

The foregoing has described the idealized situation with a well element transferred to the elevator 48 and lowered by traveling block 46 to well head 14. After running a well element into and connecting it with an existing rod or pipe string within the well head, the elevator 48 will have been lowered into a position below the APM and the APM will have returned to cooperating position with a transfer arm to grasp a second well element for connection to the well element string. With the APM returned to alignment with the wellbore and then extended to axial alignment with the well head, the new well element will be lowered into the funnel 221 and into contact with coupling 17A of the top most well element extending above the wellbore.

When the new well element is connected to the string, in the manner to be hereinafter described, the elevator is lowered slightly to release the connection between the jaws and the well element thus releasing the elevator. The elevator would then be in condition to permit the string of elements to be lowered further into the wellbore. The elevator jaws 126 and 127 may then be reset to catch the coupling as the well element is lowered and the elevator will be prepared to receive the next element to be coupled to the string.

In the reverse, when elements are being withdrawn from the well, the elevator will have its jaws in contact with the coupling 17A of the upper most element on the string and, by raising the elevator with the travelling block 46, the well element may be raised to a position where it may be grasped by the automatic pipe manipulator arms. The well element is then unscrewed from the string and then further raised to permit the automtic pipe manipulator to grasp the element. By lowering the elevator to permit the jaws 226 and 227 to be opened, the elevator may then be drawn over the top of the coupling and the automatic pipe manipulator may withdraw the pipe from alignment with the elevator and prepare to pass it to a transfer arm. At the same time the elevator 48 is being lowered into position to grasp the next well element of the string. The solid base 215 will pass over the coupling and align the coupling within the coupling guide 222. The jaws 226 and 227 are then placed into position to make contact with the bottom of the coupling and the elevator may then be raised to pull a well element section out of the well head.

The traveling block 46 is of the style known as a split block and may be the block available from Dresser Idico as a Dual Speed Traveling Block as shown and described in the 1978–1979 Composite Catalogue of Oilfield Equipment and Services, 33rd Revision-1978–1979, published by World Oil. (Gulf Publishing Co.), P. O. Box 2608, Houston, Tex., 77001. The split block permits well elements to pass vertically through the center of the block and permits the elements to be inserted horizontally into the block from the front thereof.

Power tongs 21 and backup tongs 23 are provided to produce the necessary rotation of the well element string to accomplish the coupling or uncoupling of well elements. Below the power tongs and backup tongs is a centralizer 47 to provide guidance for elements into and out of the well head, and, at the well head, a set of slips 50 are provided for holding the string of well elements against downward vertical movement when the string is released from the elevator 48.

Power tongs and their associated back-up tongs are available, as shown at page 68 in the 1978–1979 Composite Catalogue noted above from Joy Petroleum Equipment Co. as Hillman-Kelley Model 3700-H-Power Tong. The equipment is modified to provide the automatic control herein required.

The Slips are adapted from the equipment available from Cavins of Long Beach, Calif., and shown in the 1978–1979 Composite Catalogue, Pages 1621 and 1623 as Cavins "Advance" Automatic Spiders. These spiders are modified to provide the automatic control herein required.

Figure 27:
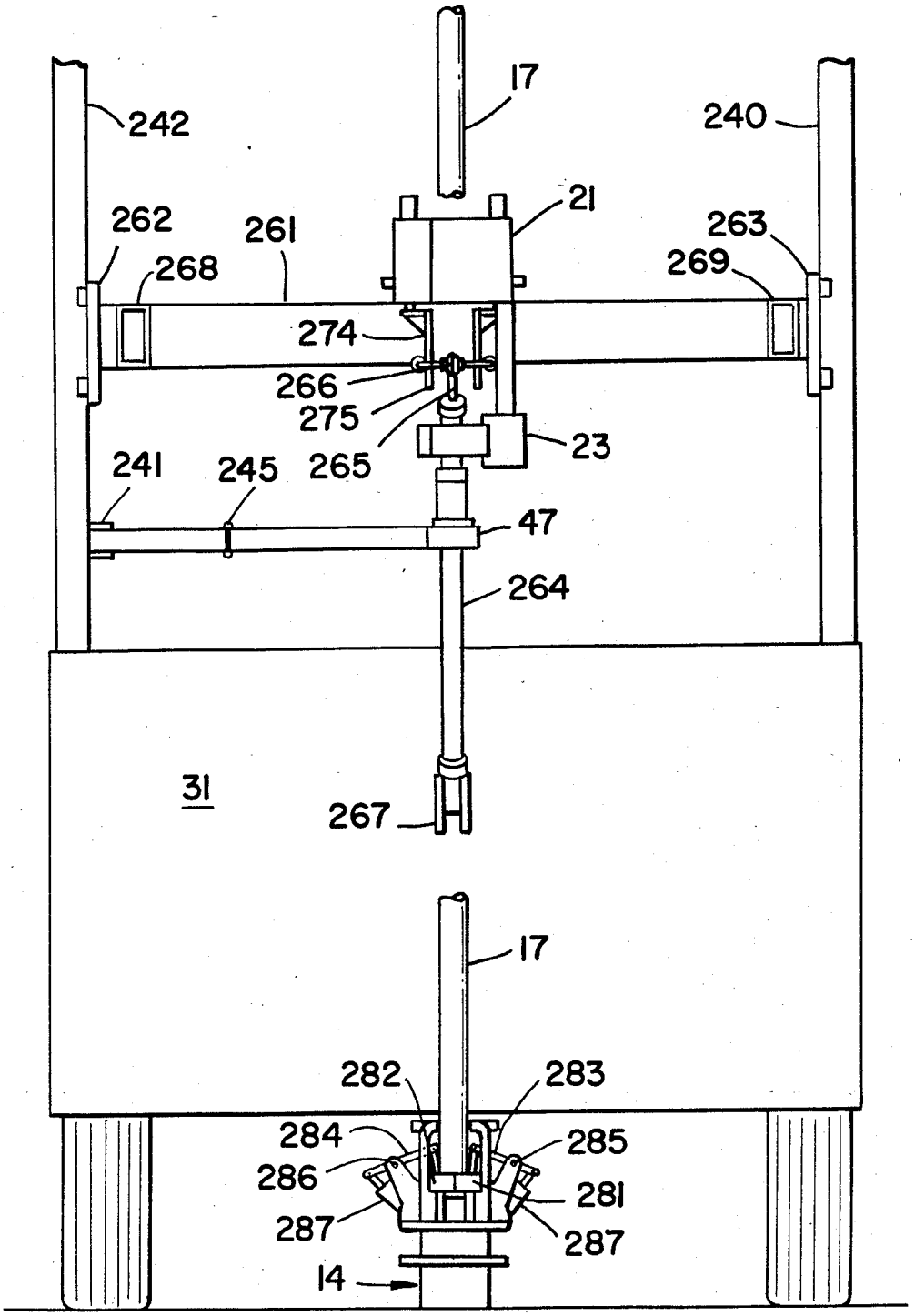
FIG. 27 is a front elevational view of the well element handling elements at the front of the rig and adjacent to the well head.
Figure 28:
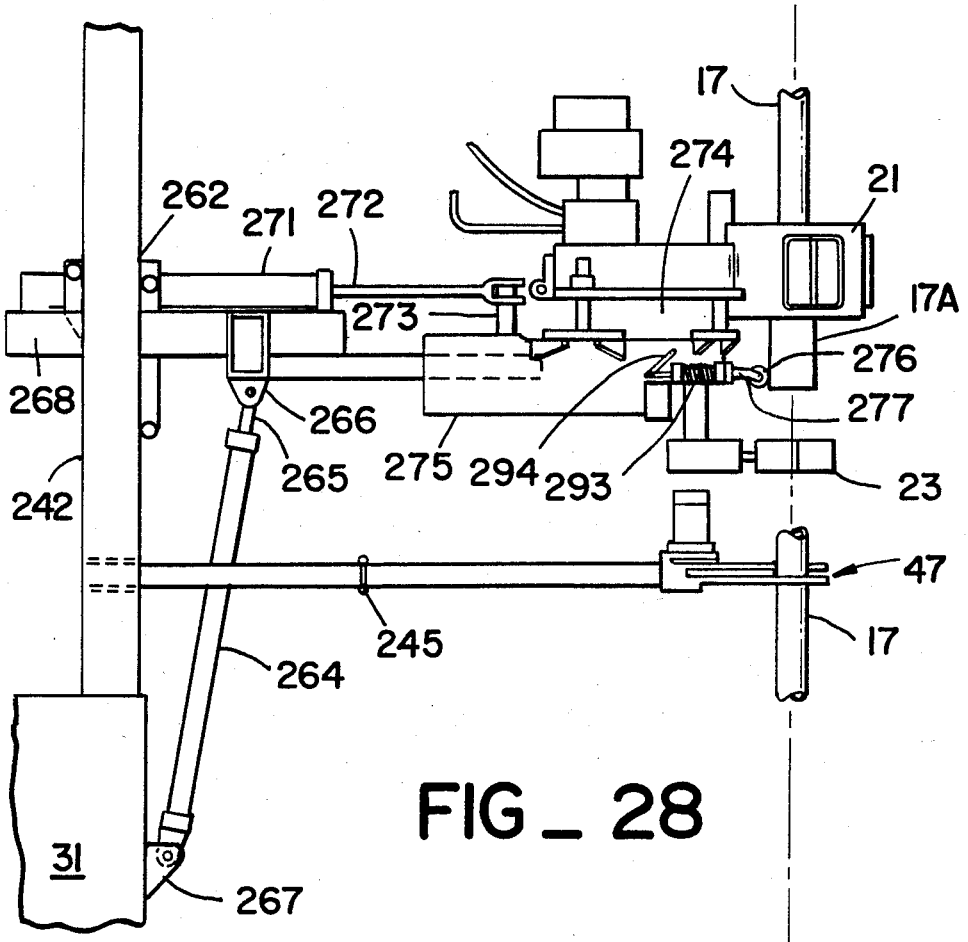
FIG. 28 is a side elevational view of FIG. 27.

FIGS. 27 and 28 illustrate the mounting and arrangement of the tongs, centralizer and slips with respect to the front end of the well servicing rig and the well head. The power tongs are supported by cross-member 261 positioned between mounting post 240 and 242 fixed to the forward end of the rig 31. The cross-member is slidable vertically along the posts through its support on guides 262 and 263 having suitable rolling contact with the posts. Vertical movement is provided by expansion of a hydraulic cylinder 264 having its expandable piston end 265 fixed to a lower portion 266 of cross-member 261 and its fixed end mounted to ears 267 fixed to the chassis of the rig 31.

Cross-member 261 is supported horizontally in guides 262 and 263 by extensions 268 and 269 at the left and right, respectively, of FIG. 27. An hydraulic cylinder 271 is supported at its fixed end to the forward end of the rig 31, by means not shown, and has its movable piston end fixed to a post 273 on support member 274 which supports the power tongs 21 and back-up 23 of a style previously described. Also supported on the support member 274 is a joint finder 275 having a roller 276 supported on a guide 277. Horizontal movement of the power tongs and back-up is accomplished by expansion and contraction of piston 271 causing movement of the extensions 268 and 269 in their support on guides 262 and 263. The joint finder 275, whose purpose will be more fully described hereinafter, is moved horizontally by operation of a piston member 278 to place roller 276 in contact with the well element 17 within the tongs and to identify the location of a joint between well elements.

Figure 32:
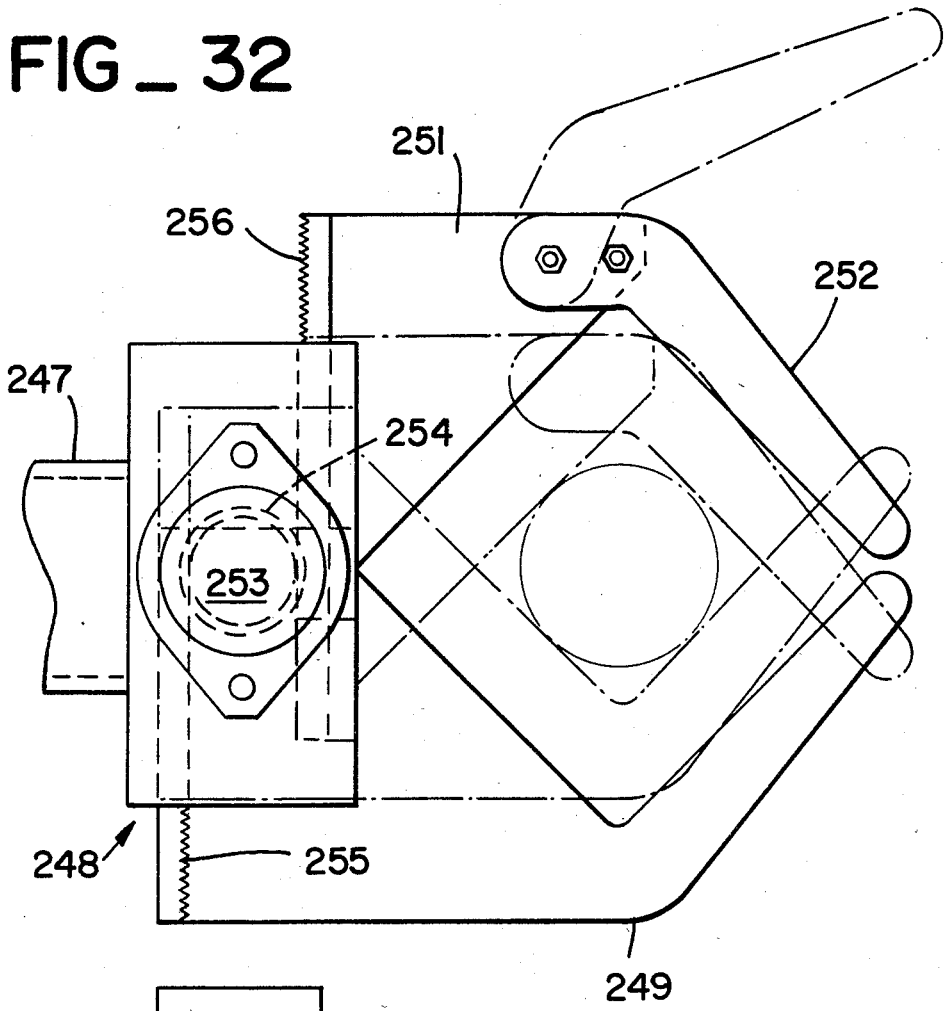
FIGS. 32 and 33 are top and side views of the jaws of the centralizer of FIG. 31.
Figure 33:
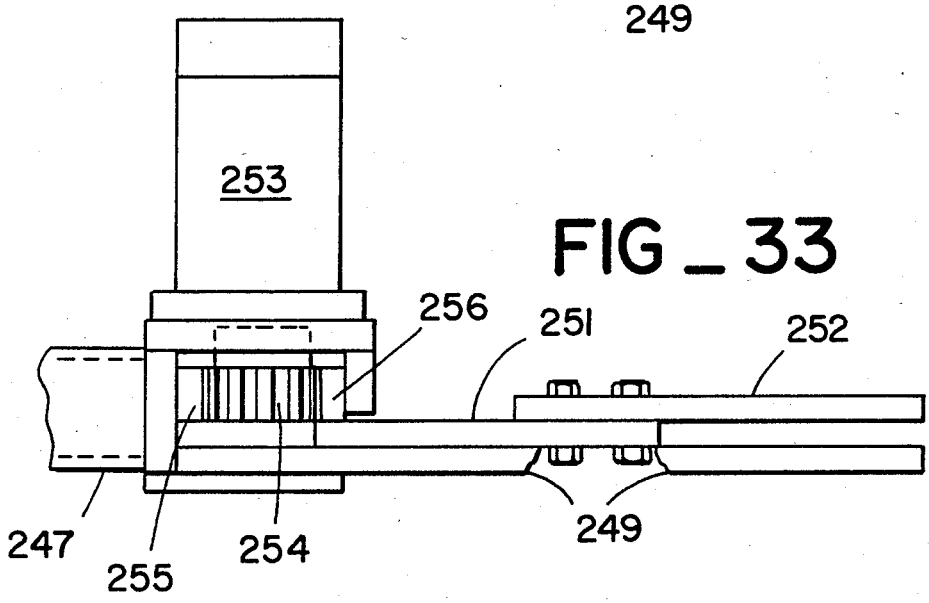

Below the power tongs 21 and back-up 23 a centralizer 47 is supported on the front end of the rig 31. FIGS. 31, 32 and 33 illustrate a foldable centralizer 47 mounted on the forward end of the well servicing rig in a position for alignment with the centerline of the wellbore. The centralizer 47 is pivoted on mounting brackets 241 fixed, as by welding, to the righthand (facing forward) mounting post 242 of the rig 31. A pivot pin 243 and locking pin 244 permit the centralizer to be extended beyond the rig 31 or folded back onto the rig. A foldable joint 245 provides a means for folding the centralizer into extend or contracted position and establishes two portions a pivoted end 246 and jaw 247 for the centralizer. A jaw means 248 is mounted to the end of the jaw portion.

The jaw means includes a pair of jaw members 249 and 251 as shown in FIG. 32 with jaw 251 having an openable finger 252. Jaws 249 and 251 are movable toward and away from each other by operation of an hydraulic motor 253 which causes rotation of a pinion gear 254 and resultant lateral movement of racks 255 and 256 mounted, respectively, on jaws 249 and 251. The jaws are adapted to close on a well element 17 as shown in phantom and to keep the well element aligned with the centerline of the wellbore. It should be noted from FIG. 1 that the centralizer is positioned between the well head 14 and the power tongs 21 and that both the centralizer 47 and the tongs 21 are a significant distance above ground level. Finger 252 is provided to permit the initial alignment of a well element within the centralizer, thereafter the elements remain within the jaws regardless of whether pipe, tubing or rods are being run.

At the top of the well head 14 a set of power-operated slips 18 are mounted. The recommended slips have the form previously described with suitable modification to permit them to be operated automatically and in accordance with the required sequencing as will be further described hereinafter. The slips as here schematically shown constitute at least a pair of toothed jaws 281 and 282 having linkage connections such as 283 and 284 pivoted on extensions 285 and 286 of the slip housing. A pair of pistons 287 and 288 are operable to move the jaws by moving the pivoted linkage to cause the slips to be opened and closed. The pistons will be controlled in the automatic sequencing as will be hereinafter described.

Figure 29:
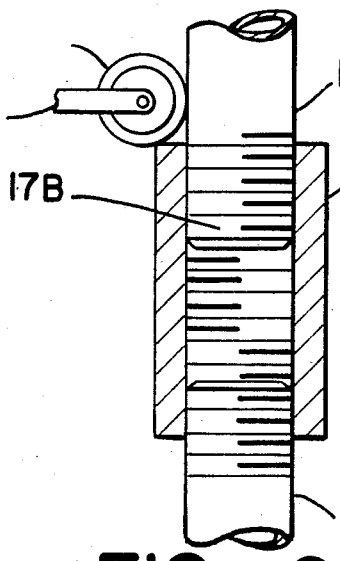
FIGS. 29 and 30 are partial sectional views illustrating the joint locating means for tubing and rod elements, respectively.
Figure 30:
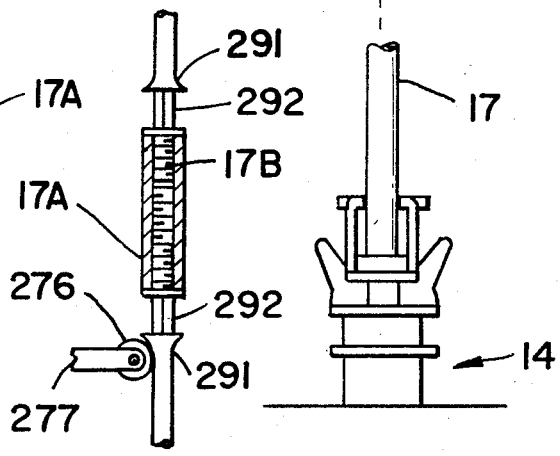

FIGS. 29 and 30 illustrate enlarged representations of the joint finding apparatus of the present invention. Roller 276 on guide 277, having at least two possible sizes for use with tubing and rods, moves with the support 274 for the power tongs 21. In making and un-making a joint between well elements it becomes necessary to grasp the upper element with the power tongs, hold the lower element and rotate the upper element. Power tongs 21 provide the grasping and rotation for the upper element and the back-up tongs 23 hold the lower element against rotation. However, because all well elements are not exactly the same length (particularly with rods), it becomes necessary to sense, the location of a joint and to position the joint and the tongs to accomplish the desired making and un-making. Joint finder 275 serves that purpose by positioning roller 276 in contact with the well element as the tongs are moved vertically along the element.

In the case of tubing, the tongs are raised to their upper limit by the piston 264 and then lowered with wheel 276 in contact with the element. When wheel 276 passes the joint 17A, the vertical movement of the tongs is stopped and, because of prior adjustment, the tongs are in position to grasp the upper element and the lower element to provide for the necessary rotary movement.

In the case of rod goods, the tongs are lowered to their bottom and raised by the piston 264. When the upset 291 along the rod is sensed, the tongs are stopped. In that position the tongs will be in position to grasp the upper element and back-up tongs in the form of a fork will contact the flat 292 between the upset and the joint 17A.

Spring 293 on roller guide 277 biases the roller 276 toward the well elements 17 and movement of an extension of the guide 277 operates a sensor at 294 to stop the further movement of the tongs.

Automatic sensing and control means are associated with each of the elements performing a function on the maneuvering of the well elements so that the entire operation of the well servicing rig is accomplished without the need of direct human contact. FIGS. 37A, 37B, 37C and 37D present a graphic representation of the operations being sensed and controlled. Adjacent the first lefthand numerical column is a column wih words describing the function that the particular element accomplishes, and in the next series of columns extending to the right are timing periods during which the action is accomplished. The horizontal bars indicate the time period in a cycle during which the function is performed. Numbers associated with the bar refer to numbered sensors which are listed in FIGS. 38A, 38B and 38C.

Figure 37A:
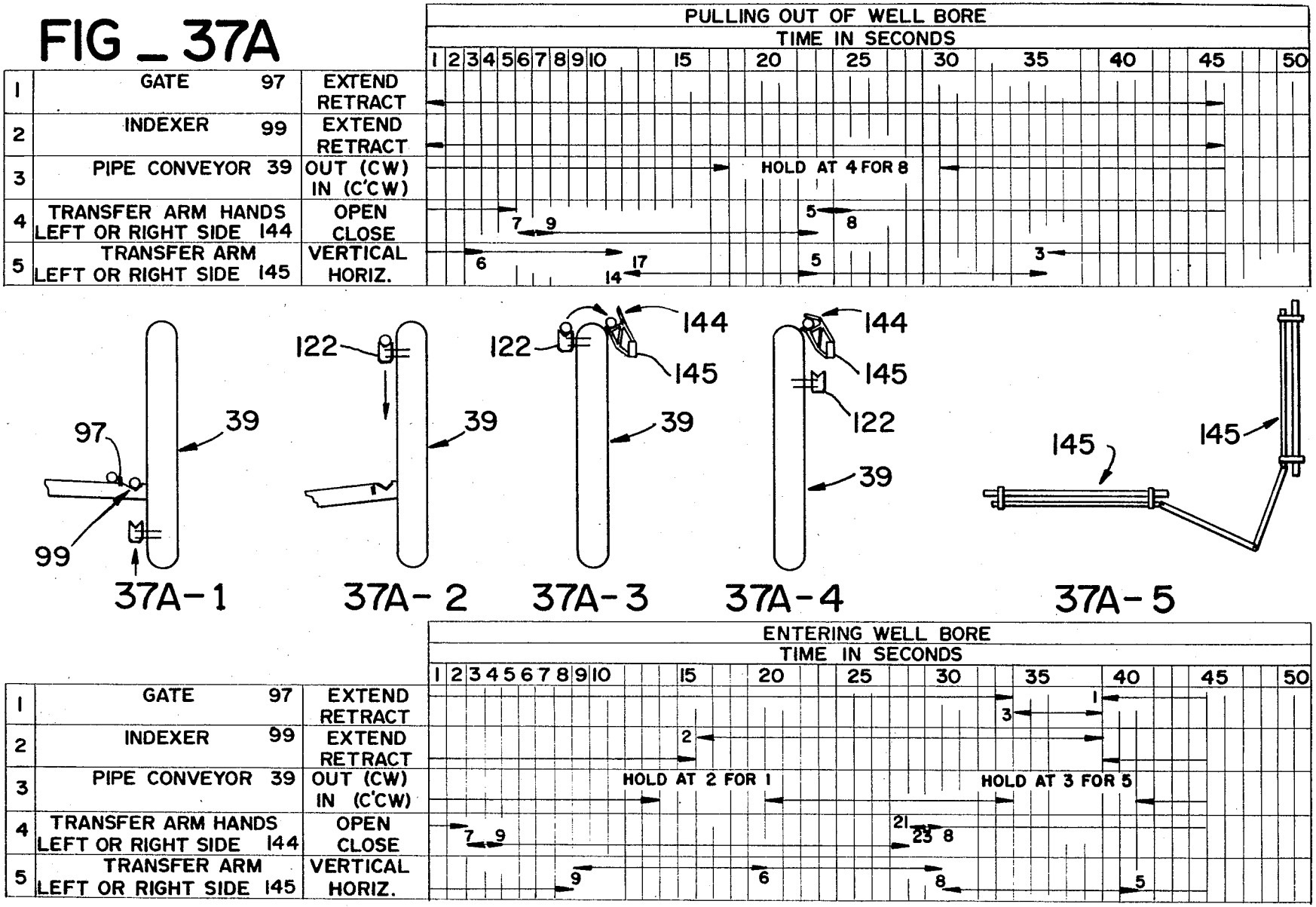
FIGS. 37A, 37B, 37C and 37D are chart representations of the sequencing of the operations of the various elements of the present invention.
Figure 37B:
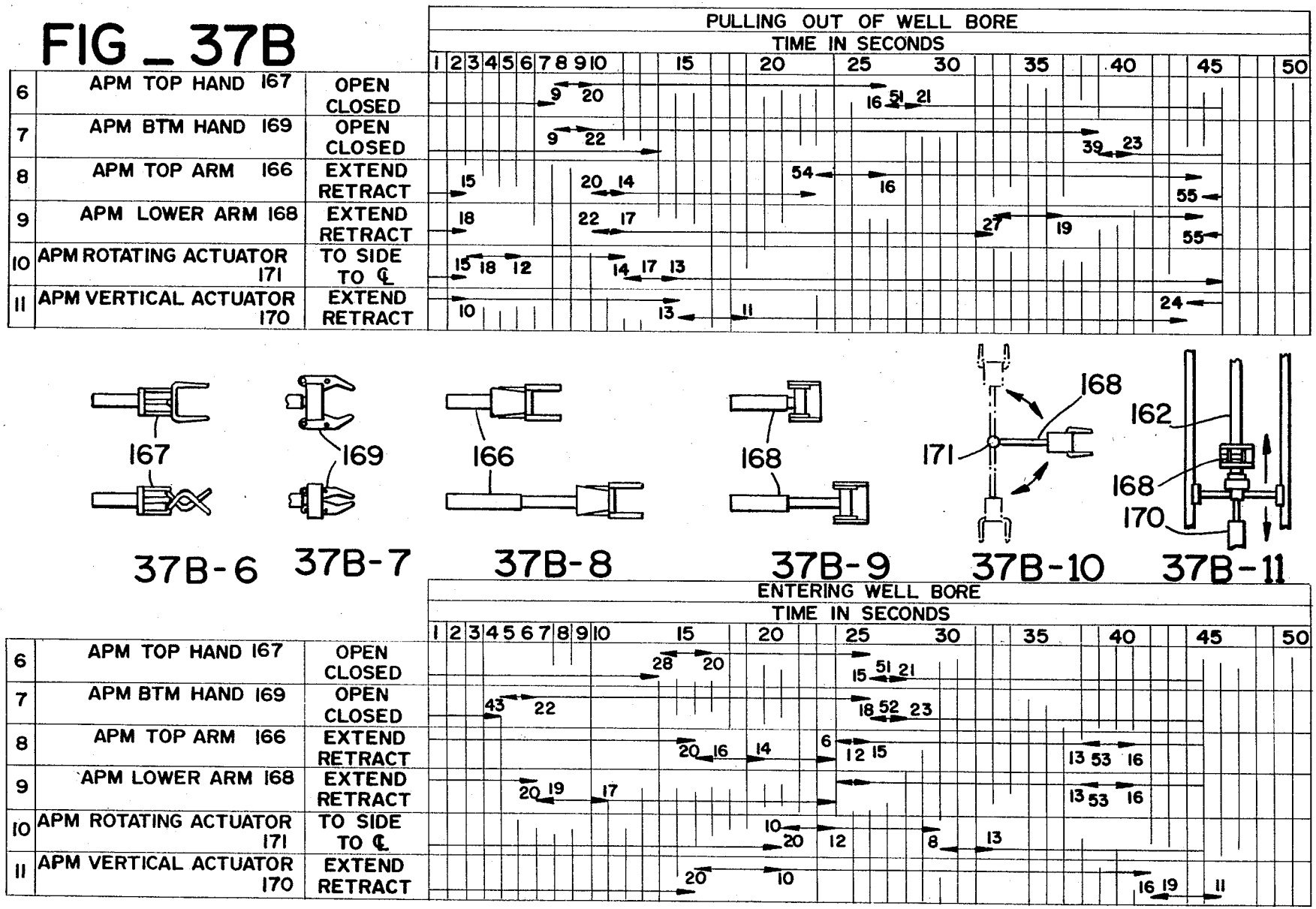
Figure 37C:
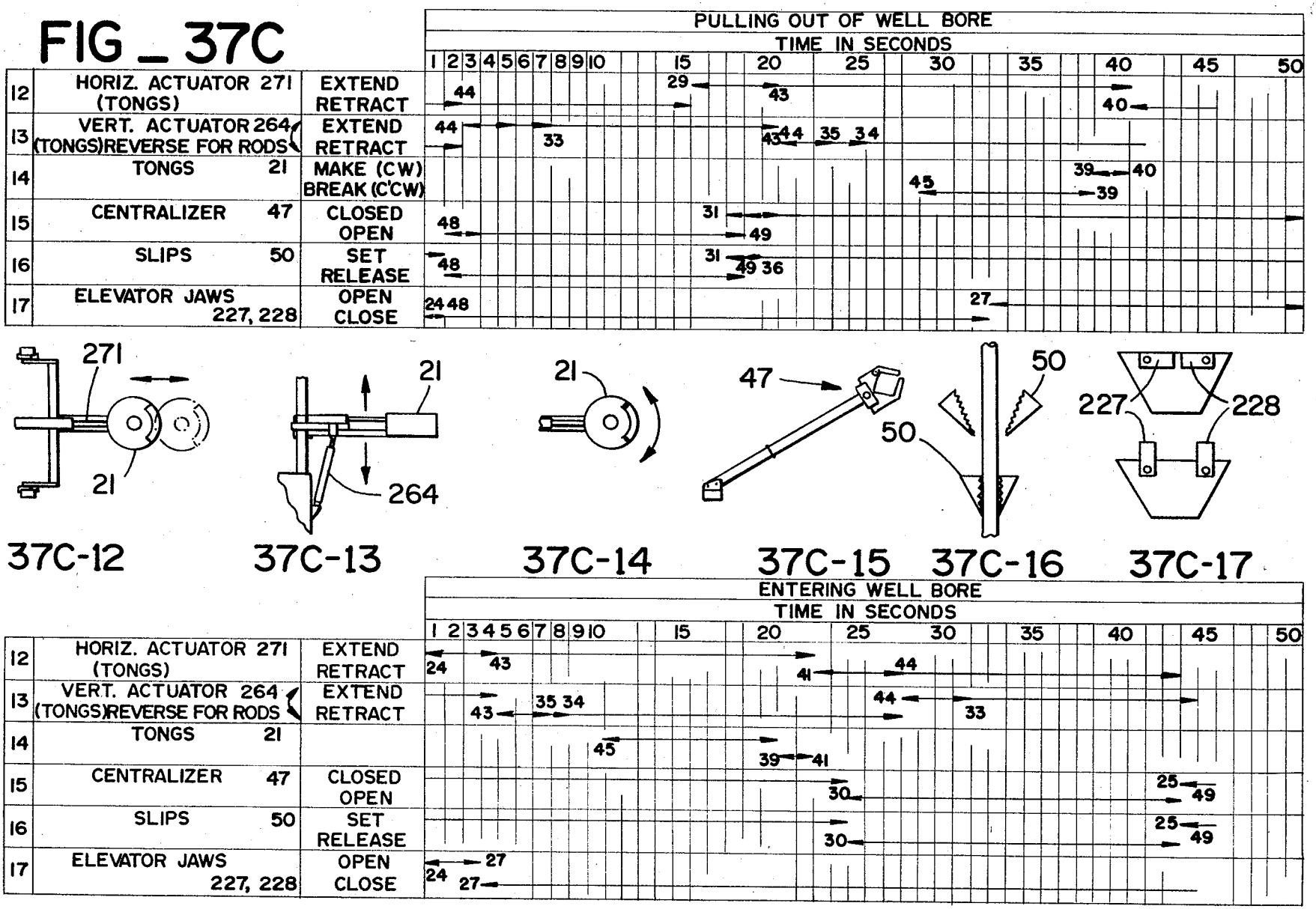
Figure 37D:
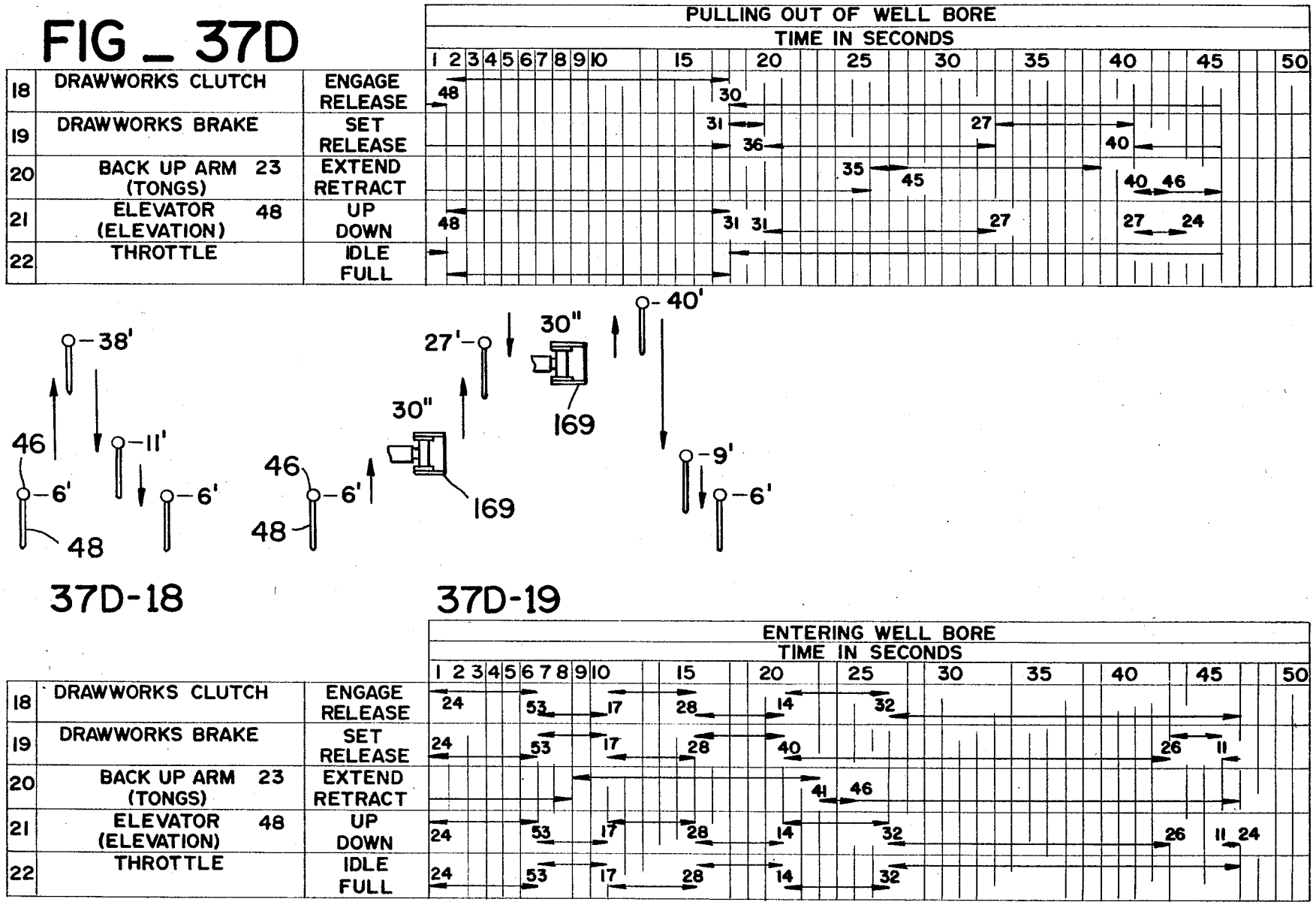

Referring now to FIG. 37A, the upper and lower portions of the figure are intended to illustrate, in the upper portion, the operations of each of the elements when pulling well elements out of the wellbore and, in the lower portion, when running well elements into the wellbore. Between the two sections of the chart there are schematic illustrations of the functions designated in accord with the numerical column.

Figure 38C:
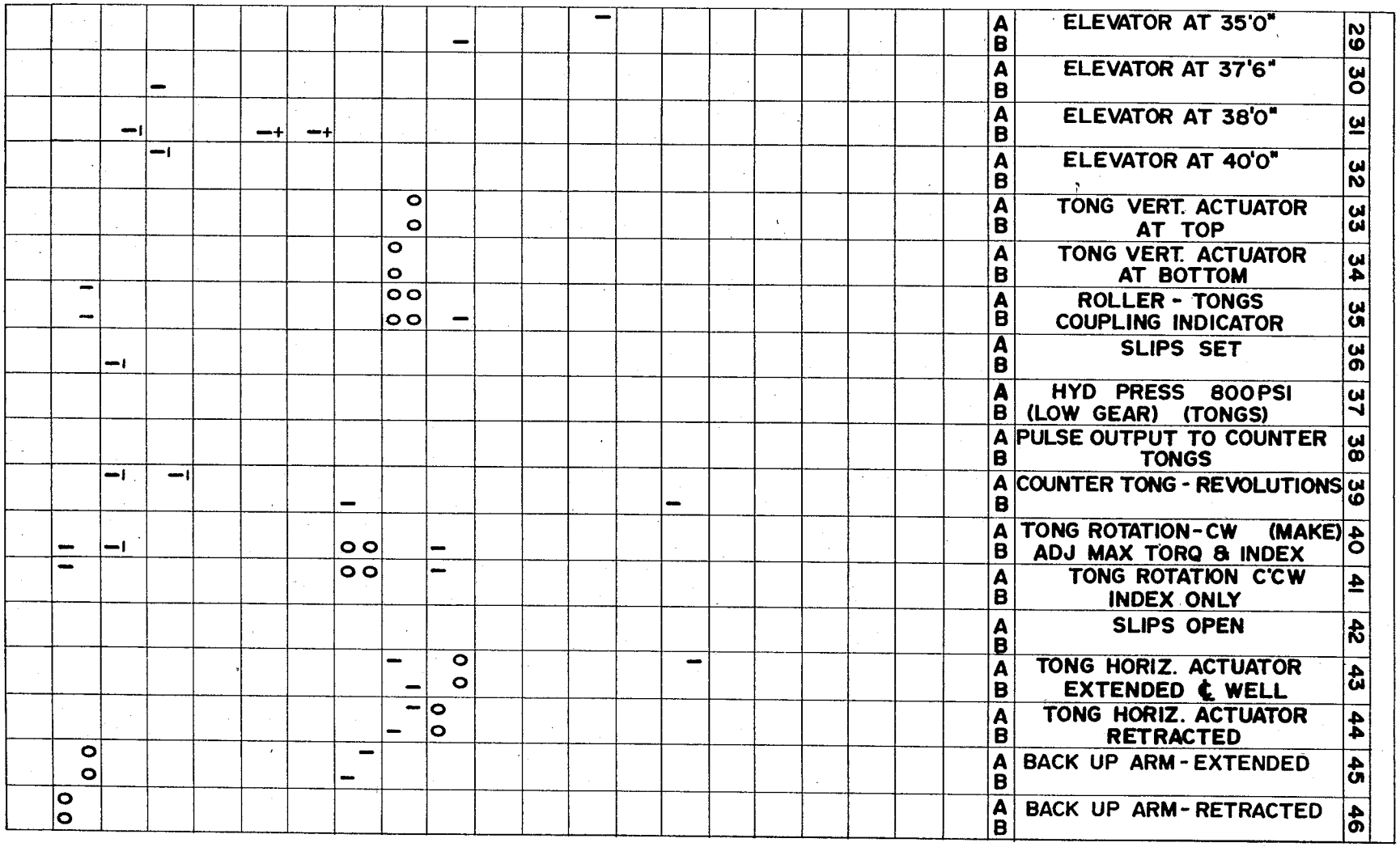

FIGS. 38A, 38B and 38C are a chart form representation of the sensor operations for the automatic well servicing rig of the present invention. It should be understood that sensing means (or sensors) will be associated with each of the elements of this invention to provide an indication to a master control as to the condition or sequence of conditions performed by the elements of the rig. As the elements of the rig have been described, their operation in the overall operation of the rig have also been described. It should be evident that sequencing of operations is an essential feature of this invention and the automatic operations it controls. FIGS. 37A, 37B, 37C and 37D have illustrated the sequence of events for running elements into or out of a well; FIGS. 38A, 38B and 38C illustrate the conditions that must occur before a series of events can happen.

Across the top of each of FIGS. 38A, 38B and 38C a series of sensors are identified in numerical order. Below each sensor its function is described. For example, sensor 1 senses the existence of a pipe (or other well element) within the indexer 91. The letters A and B below the sensor designations distinguish between the operation when running elements into the well (A) and when pulling elements out of the well (B).

Along the lefthand side of FIG. 38A in a vertical column is a listing of actuators with numerical ordered and named identification. The names are the same as those shown in FIGS. 37A, 37B, 37C and 37D. The actuators and the sensors are related as to their functions during the automatic operation of the rig. To the right of the actuator description are word descriptions of the operation performed by the actuator. For example Actuator 1-Gate 97 can be either "extended" or "retracted".

Within the body of the charts FIG. 38A, 38B, and 38C there are designations of 1, 0, + and OR. These designations have the following descriptions:

1 = initiates an actuator

0 = stops an actuator

+ = designates an "and" circuit, which establishes that two or more conditions must exist before an action occurs − = designates an "OR" circuit, which establishes that two or more conditions may exist to effect an action.

For example, in FIG. 38A, with the rig operating to run elements into the well, sensor 1 will sense an element in the indexer 91 and gate 97 will be extended to prevent another element from entering the indexer. A stop operation example is established where the rig is operating to run elements into the well and sensor 2 establishes that the lifter jaw 122 of the conveyor 39 is at the bottom of the conveyor. The conveyor 39 will stop in that location until pipe indexer sensor 91 senses that a pipe is in the indexer. Further, reading to the right along actuator 3 (pipe conveyor line), the litter jaw 122 will be stopped at the top of the conveyor 39 until sensor 5 establishes that the transfer arm 41 (on the same side of the rig) has been positioned in a horizontal position.

An example of an "and" operation in shown in referring to actuator 5-Transfer Arm 41 (left or right side) and sensor 14 on APM upper arm 166 and sensor 17 on APM lower arm 168 and when well elements are being pulled out of the well. It should be recalled that where elements are being pulled from the well the elements are pulled vertically and grasped by the APM hands, the APM retracts to its 35-inch position and is prepared to rotate right or left to place the element into the hands 144 of the transfer arm 41. After the transfer has been made to the hands of the transfer arm, sensor 7 recognizes that an element is in the hands and sensor 9 recognizes that the transfer arm hands 144 are closed, then the APM upper and lower arms can retract to 30″ position and the transfer arm can be lowered to horizontal position. The signals from sensors 14 and 17 must indicate that both arms are retracted before the transfer arm lowers to horizontal.

An example of an "OR" operation can be seen by referring to FIG. 38A at Actuator 9-APM lower arm and to sensors 12 and 13. As shown on the chart, when elements are being run into the well, APM lower arm 168 will be extended if the APM is rotated, either right or left, to alignment with a transfer arm 41 or if the APM is rotated to alignment with the centerline of the wellbore. In either of those positions the APM may be extended. In any other rotational position the APM should be prevented from extending. When running into the well, the APM will retract to the 30-inch position before rotating toward the APM.

The following is a description of the operation of the elements of the present invention when running elements into and pulling elements out of a well. Reference to elements are by reference number; reference to sensors is by numbers which are found in the upper horizontal sequence across FIGS. 38A, 38B, 38C and 38D.

GOING IN

1. Gate (97)

Pipe conveyor 122 reaches top, sensor 3 is actuated and retracts gate 97. As soon as pipe rolls into indexer, sensor 1 is actuated and gate 97 extends. If a pipe is in indexer 99 and sensor 3 is actuated, gate 97 will not retract.

2. Indexer (91)

When pipe is in indexer 99, sensor 1 is actuated and retracts indexer. When pipe conveyor 122 reaches bottom, sensor 2 is actuated and indexer 99 extends.

3. Pipe Conveyor (39)

When pipe is in indexer 99, sensor 1 is actuated, and transfer arm 145 is horizontal, sensor 5 is actuated and the conveyor rotates to carry pipe from the pipe rack to the transfer arm hands.

Sensor 2 holds the conveyor at the bottom for signal from sensor 1 and sensor 3 holds the conveyor at the top for signal from sensor 5.

4. Transfer Arm Hands (144)

When the pipe is placed in both transfer arm hands 144, a sensor 7 is each hand, connected in series, actuates main valve to close both hands. When the pressure builds in the line to close the transfer arm hands, pressure sensor 9 actuates valve to shut off pressure from sensor 7 permitting it to go to neutral. When APM hands 167 and 169 close around pipe, pressure sensors 21 and 23 cause the transfer arm hands to open. Pressure build-up in line to open transfer arm hands actuates sensor 8 and valve goes to neutral.

5. Transfer Arm (145)

When the pipe is in the transfer arm hands 144, they close and the pressure rises as pipe is gripped, sensor 9 is actuated to cause transfer arm to rise to vertical. In the vertical position, sensor 6 is actuated to cut off pressure to main valve and permit it to go to neutral. When the pipe is transferred to the APM 45, the transfer arm hands 144 open and the pressure build-up actuates sensor 8 to shift main valve to cause transfer arm to go horizontal. When it is horizontal, sensor 5 cuts off and vents pilot pressure and permits main valve to go to neutral.

6. APM Top Hand (167)

When APM top hand 167 moves to the 35-inch radius (R) and the hands contact the pipe, sensors 15 and 51 are actuated and shift main valve to close APM top hand 166. As the pressure builds, pressure sensor 21 is actuated and cuts off and vents pressure to pilot permitting main valve to go to neutral. When elevator 20 is on the way up and passes the 27-foot level, sensor 28 is actuated and shifts main valve to open hand 167.

7. APM Lower Hand (169)

When APM lower hand 169 moves to the 35-R and the hand contacts the pipe, sensors 18 and 52 are actuated and shift main valve to close APM lower hand. As the pressure builds, pressure sensor 23 is actuated and vents pressure permitting main valve to go to neutral when the tongs 21 move to centerline of the well, sensor 43 is actuated and shifts main valve to open APM lower hand. As the pressure builds, pressure sensor 23 is actuated and cuts off and vents pressure to pilot permitting main valve to go to neutral.

8. APM Top Arm (166)

1. APM top arm 166 is at the 30-R position. It rotates to the side and as soon as the transfer arm 145 gets to the vertical position, sensors 6 and 12 are actuated which shifts main valve to extend APM top arm 166. When it gets to the 35-inch R, sensor 15 cuts off and vents pilot pressure and main valve goes to neutral, stopping arm 166. When the pipe is secured in the APM lower hand 169 and the APM 45 has rotated back to center, sensors 13 and 23 are actuated which shifts main valve and arm 166 extends to 55-inch R. Sensor 16 is actuated to cut off and vent pilot pressure and main valve goes to neutral.

2. When the pipe is in place and the APM upper hand 167 opens, sensors 16 and 20 actuate a pilot valve to give a signal to shift main valve and retract arm 166. At 30-inch R position sensor 14 is actuated to cut off and vent pilot presure to main valve to permit it to go to neutral and shift pilot valve to closed position.

9. APM Lower Arm 168

Same as APM top arm except for the different sensors for the lower arm.

10. APM Rotating Actuator

1. When the APM 45 is in the up position and upper hand 167 is open, sensors 10 and 20 are actuated and shift main valve and cause rotary actuator 171 to rotate to side selected. At full rotated position sensor 12 is actuated and permits main valve to go to neutral. As soon as upper hand 167 closes around tube, the rotation signal is gone.

2. When tube is transferred from transfer arm 145 to APM 45 and transfer arm hands 144 open, sensor 8 is actuated to shift main valve to cause rotary actuator 171 to rotate and return to center position where sensor 13 is actuated and permits main valve to go to neutral.

11. APM Vertical Actuator

1. When APM 45 has tube in both hands 167, 169 and extends both arms 166, 168 to 55-inch R, sensors 16 and 19 are actuated which shifts main valve and actuator 170 retracts and APM goes down. When APM gets to bottom, sensor 11 is actuated and cuts off pilot pressure and permits main valve to go to neutral.

2. After the tube is attached to elements within the tongs, the APM arms 166, 168 retract to 30-inch R and actuates sensor 14 which shifts main valve to extend actuator 170 and APM goes up. In the up position, sensor 10 is actuated and cuts off pilot pressure permitting main valve to go to neutral.

12. Tongs Horizontal Actuator (271)

1. When the APM 45 is in the bottom position, sensor 1 is actuated which shifts main valve to extend the tongs horizontal actuator 271. When the tongs 21 reach the centerline of the well, sensor 43 is actuated which cuts pilot pressure off main valve and it goes to neutral.

2. After tongs 21 make up joint and reverse rotation and lock open pressure, sensor 41 shifts main valve to retract tongs. When tongs are fully retracted, sensor 44 is actuated to permit main valve to go to neutral.

13. Tongs—Vertical Actuator (264)

1. When tongs horizontal actuator 271 extends to center of well, sensor 43 is actuated and shifts main valve to retract actuator and tongs 21 move down (when running pipe) or up (when running rod). When Roller 276 contacts coupling 17A, sensor 35 is actuated and cuts off pilot pressure and main valve goes to neutral and holds tongs 21 at that level.

2. After the joint is made up, the tongs horizontal actuator 271 is retracted. As soon as the tongs back away, neither sensor 43 or 35 are actuated and when the tongs horizontal actuator 271 is fully retracted, sensor 44 is actuated and shifts main valve to extend tongs vertical actuator 264 and cause tongs 21 to move up. When tongs reach top, sensor 33 is actuated to cut pilot pressure to main valve which goes to neutral.

14. Tong Rotation

When Roller 276 locates pipe coupling, sensor 35 is actuated and shifts main valve to rotate tongs 21 clockwise and make up coupling. When high torque is achieved, pressure sensor 40 is actuated to cut off sensor 35 and reverse main valve to reverse rotation of tongs 21. The signal from sensor 40 goes through a "Time Delay on Release" (TDR) to maintain the signal until tongs can reverse rotation, lock open and back off of coupling.

15. Centralizer (47)

1. Going in when elevator 48 is at 27-foot, sensor 28 is actuated to shift main valve to open the centralizer jaws 249, 251. When slips 50 are set, the signal that was started by sensor 28 is cut off.

2. When the slips are set and the elevator is at 8'-0" level, the centralizer jaws 249, 251 close. When elevator is at 27'-0", sensor 28 actuates valve to cut off signal started by 25.

16. Slips (50)

1. When elevator 48 is at 35'-0" going up, sensor 29 is actuated to shift main valve to release the slips as soon as the load is taken off. When the elevator 48 lowers to the 8'-0" level, the brake on the drive to the traveling block 46 is set, actuating sensors 49 and 28 to shift main valve to set the slip jaws 281, 282.

17. Elevator Jaws (227, 228)

When APM is at bottom, sensor 11 actuates jaws 227, 228 to open. When elevator 48 is at 11, sensor 27 actuates jaws 227, 228 to close.

18. Drawworks Clutch

Lowering joint (clutch released) brake stops elevators at 8'-0" APM stabs next joint and elevators drop to 6'-0" (sensor 24) and engages clutch. Elevators raise to 27'-0" and if APM top arm 166 not at 30-inch R, clutch releases until arm at 30-inch R. Elevator 48 continues up to 40'-0" (sensor 32) and clutch releases. Elevator 48 falls with string.

19. Drawworks Brake

1. Elevator 48 sliding up tubing and tonging up joint. Elevator stop at 27' (sensor 28) until tongs make up (sensor 40) then brakes release, clutch engages and elevator continues up.

2. Elevator 48 lowering string into holes and stops at 9'-0" elevation (sensor 26) until APM vertical actuator hits bottom (sensor 11) when slips are set (sensor 36) and brakes release.

20. Back-up Arm Tongs

21. Engine Throttle

1. Throttle advances, clutch engages, when elevator 48 hit 6'-0" elevation (sensor 24).

2. With elevators at 16 feet (sensor 53) clutch releases and throttle goes to idle.

3. When lower arm APM 168 is at 30-inch R (sensor 17), clutch engages and throttle advances.

4. When elevator at 271 (sensor 28) clutch releases and throttle goes to idle.

5. When upper APM arm 166 is at 30-inch R (sensor 14), clutch engages and throttle advances.

6. When elevator is at 40 feet (sensor 32), clutch releases and throttle goes to idle.

COMING OUT

1. Gate (97)

1. Coming out the gate 97 is held in the retracted position at all times.

2. Indexer (91)

1. The indexer is held in the retracted position.

3. Pipe Conveyor (39)

When transfer arm hand 144 is open, sensor 8, pipe conveyor rotates clockwise. If lifter jaw 122 is at back of conveyor, sensor 4, and transfer arm hand 144 is not open, sensor 8, pipe conveyor stops.

4. Transfer Arm Hands (144)

1. When APM 45 puts tube into the hands 144 of the transfer arm 145, sensors 7 are actuated to shift main valve to close hands. When the pressure builds, pressure sensor 9 is actuated to cut off pilot pressure and permit main valve to go to neutral.

2. When the transfer arm 145 is horizontal sensor 5 is actuated to shift main valve to open hands. Pressure build-up actuates pressure sensor 8 to cut off pilot pressure and main valve to neutral.

5. Transfer Arm (145)

1. Transfer arm 145 is vertical and the APM 45 transfers tube to transfer arm 145 and both APM arms 166, 168 retract to 30-inch R, sensors 14 and 17 actuate main valve to rotate transfer arm 145 to horizontal. when horizontal, sensor 5 is actuated to cut off pilot pressure to permit main valve to go neutral.

2. When tube reaches top of conveyor 39, sensor 3 is actuated momentarily to shift valve to give a sustained signal to shift main valve to rotate transfer arm 145 to vertical. Sensor 6 is actuated to shift valve back and permit main valve to go neutral.

6. APM top hand (167)

1. When APM upper arm 167 is at 55-inch R and tube is in APM upper hand, sensors 16 and 51 are actuated to shift main valve to close hand. pressure sensor 21 is actuated to cut off pilot pressure and main valve goes to neutral.

2. When APM upper hand transfers tube to transfer arm hand 145, sensor 9 is actuated to shift main valve to open APM upper hand 167 which actuates pressure sensor 20 to cut off pilot pressure to permit main valve to go to neutral.

7. APM lower hand (169)

1. The APM arms 166, 168 are extended to 55-inch R, when sensor 39 is actuated (counting tong revolution on break) actuates main valve to close hand 169. Pressure sensor 23 cuts off pilot pressure and main valve goes to neutral. Sensor 9 senses transfer arm hands closed. Lower APM hand opens with signal from sensor 22.

8. APM Top Arm (166)

1. When APM 45 reaches the top position sensor 10 is actuated to shift main valve to retract arm 166. When arm gets to 35-inch R, sensor 15 is actuated to shift valve and cut off signal from sensor 10 and main valve goes to neutral to hold arm at 35-inch R. After tube is transferred to transfer arm 145 and APM hands 167 and 169 open, pressure sensor 20 again shifts main valve to retract arm to 30-inch R, where sensor 14 is actuated to cut off pilot pressure and main valve goes to neutral.

9. APM Lower Arm (168)

1. Works same as upper arm 166 except for the different sensors and retract simultaneously with the upper arm.

10. APM Rotating Actuator (171)

1. When both upper and lower APM arms 166, 168 are retracted to 35-inch R, sensors 15 and 18 are actuated to shift main valve to rotate APM to the side where sensor 12 is actuated to cut off pilot pressure and permit main valve to go to neutral.

2. When the tube is transferred to the transfer arm 145 and both upper and lower APM arms 166, 168 are retracted to 30-inch R, sensors 14 and 17 are actuated which shifts main valve to cause APM to rotate back to center position where sensor 13 is actuated to cut off pilot pressure and permit main valve to go to neutral and hold APM in middle position.

11. APM Vertical Actuator (170)

1. When both upper and lower APM arms 166, 168 are retracted to 30-inch R, sensors 14 and 17 are actuated and shift main valve to cause APM to move down at the same time the APM is rotating back to center. In full down position, sensor 11 is actuated to cut off pilot pressure and permit main valve to go to neutral.

2. After the tube is secured in both APM hands 167, 169 and the elevator 48 drops to the 6'-0" level sensor 24 is actuated to shift main valve to cause APM to rise. At the top position sensor 10 is actuated to cut off pilot pressure and permit main valve to go to neutral.

12. Tongs Horizontal Actuator (271)

1. When the elevator 48 is at the 35'-0" level sensor 29 is actuated to shift main valve to extend the horizontal actuator to the centerline of well, sensor 43 is actuated which cuts off pilot pressure, and main valve goes to neutral.

2. After tongs 21 uncouple the tube and lock in open position, pressure sensor 40 is actuated to shift main valve to retract the horizontal actuator. Then sensor 44 cuts off pilot pressure and permits main valve to go to neutral.

13. Tongs Vertical Actuator

14. Tong Rotation

1. When the roller 276 contacts the coupling, sensor 35 is actuated to shift main valve to rotate tongs 21 counter clockwise. After specified number of revolutions, counter actuates sensor 39 which cuts off sensor 35 and shifts main valve and reverses tongs to clockwise rotation and lock tongs in open position.

15. Centralizer (47)

1. When the elevator jaws 227, 228 close to pull the string, sensor 48 is actuated and shifts main valve and opens centralizer jaws 249, 251. Pressure sensor cuts off pilot pressure and permits main valve to go to neutral.

2. When the elevator 48 is at 38'-0" and the slips 50 are set, sensors 31 and 50 are actuated which shifts main valve to close centralizer jaws 249, 251. Pressure sensor cuts off pilot pressure and main valve goes to neutral.

16. Slips (50)

1. When elevator jaws 227, 228 close sensor 48 is actuated and main valve shifts to release slip jaws 281, 282.

2. Brake set and elevator 48 at 38'-0" level sensors 31 and 49 actuate main valve and closes slip jaws 281, 282.

17. Elevator Jaws

When elevator 48 is at 6 feet, sensor 24 actuates jaws 227, 228 to close. When elevator 48 is at 11 feet, sensor 27 actuates jaws to open.

18. Drawworks Clutch

Elevator 48 drops over coupling and closes (sensor 48) and clutch engages and raises dtring to 37'-6" (sensor 30) and clutch releases.

19. Drawworks Brake

1. Elevator 48 hoisting string out of hole. Releases brake when slips are set (sensor 36).

2. Elevator sliding down joint and stops at 11'-0" elevation (sensor 27) until tongs index (sensor 40) and then continues down.

20. Back-up Arm Tongs

Same as operation of tongs horizontal actuator (271).

21. Engine Throttle

1. Elevator 48 at 6' (sensor 24) and elevator jaws closed (sensor 48), clutch engages and throttle advances.

2. Clutch releases at 11 feet (sensor 27) if top and bottom arms 166, 168 are not back to 30-inch R (sensors 15 and 18).

3. Clutch release at 39'-6" (sensor 30) and throttle goes to idle until sensor 48 again indicates that elevator jaws are closed.

In the preferred form of the apparatus of the present invention a single engine-driven pump system will be provided to supply all operating systems. The pump system will include both pneumatic and hydraulic pumps with reservoir systems to provide basic power for driving the wheels and other vehicle control systems as well as the necessary sensor and actuator controls. Safety requirements limit the use of electrical systems around a petroleum well head and hydraulic and pneumatic systems provide the needed power and dependability. In the preferred form of the apparatus, a central power system is provided on the rig at 35 and hydraulic drive systems are supplied by that equipment to the hoist mechanism at 36.

While a certain preferred embodiment of the invention has been specifically disclosed, it is understood that the invention is not limited thereto as many variations will be readily apparent to those skilled in the art and the invention is to be given its broadest possible interpretation within the terms of the following claims.

What is claimed is:

1. A totally contained movable rig, including a frame portion thereon, for servicing and drilling and for handling elongated well elements from a horizontal storage position to a vertical position in operating relationship with a well, or the reverse of said positions, comprising:

(a) horizontal storing means mounted on said frame of said movable rig for storing said well elements in horizontal position, said horizontal storing means including a pair of pipe rack arms pivotally mounted on each side of said frame of said movable rig so as to be pivoted about a vertical axis between stored position in alignment with said frame and operating position generally horizontal and perpendicular to said frame and a pair of crane means rotatably mounted on said frame of said movable rig so as to be in operational relationship with said pipe rack arms to load and unload said elongated well elements from said pipe rack arms;

(b) conveying means mounted on said frame of said movable rig for conveying individual well elements from said horizontal storing means to a transfer location;

(c) transfer means mounted on said frame of said movable rig including means for holding said individual well elements and means for rotating said well elements to a vertical position parallel to the center line of said well;

(d) manipulating means mounted on said frame of said movable rig including means for grasping said well element from said transfer means and moving said well element in a horizontal direction to position the longitudinal axis of said well element in alignment with the center line of said well;

(e) means, mounted on said frame of said movable rig, for moving said well element along said longitudinal axis thereof into operative position with respect to said well;

(f) power rotating coupling means mounted on said frame of said movable rig for coupling said well element to other well elements located in said well;

(g) and control means for sequencing the operation of said conveying means, said transfer means, said manipulating means, said means for moving, and said power rotating coupling means to accomplish said handling of said well elements into and out of said operating relationship with said well totally automatically;

wherein the means of (a) through (e) above are adapted to be placed in operative position when said rig is positioned for operation with respect to a well, and said means of (a) through (e) are stored on said rig when said rig is being moved from place to place.

2. The apparatus of claim 1 with the addition of a derrick having a pair of legs, an upper cross-member fixed to said legs for supporting a crown block and hoist means above said well bore, and guy means for said derrick to provide stabilization therefore; said legs and guy means being spaced with respect to each other to permit said transfer means and said manipulating means to operate between said legs and without interference with said guy means.

3. The apparatus of claim 2 wherein said transfer means comprises two rigid members pivoted on a portion of said rig and operable to rotate about said pivot between horizontal position cooperating with said conveying means and vertical position cooperating with said manipulating means, said rigid members operating one on each side of said rig and said manipulating means.

4. An apparatus of claim 3 wherein a pair of gripper hands are attached to said rigid members in cooperating alignment with elements of said conveying means.

5. The apparatus of claim 4 wherein said gripper hands have well element indexing means for positioning said well elements and means operable to lock said well elements within said gripper hands in said indexing means.

6. The apparatus of claim 5 wherein said rigid members in said horizontal position locate said gripper hands both to receive said well elements from said conveying means and to release said well elements to said conveying means, and said rigid elements in said vertical position locate said gripper hands both to receive said well elements from said manipulating means and to release said well elements to aid manipulating means.

7. The apparatus of claim 3 including controllable mechanical means for each of said rigid members to move said rigid members independently between horizontal and vertical position.

8. The apparatus of claim 3 wherein said rigid members move about their pivot in parallel planes between horizontal and vertical position, said planes being between the central axis of said manipulating means and between said legs of said derrick.

9. The apparatus of claim 8 wherein said manipulating means is supported on said legs of said derrick and includes a rotatable member for positioning said manipulating means in alignment with said transfer means and for alignment with said well.

10. The apparatus of claim 9 wherein said manipulating means is vertically aligned parallel to said center line of said well and includes a pair of vertically-spaced clamping means, said clamping means being:

(a) rotated with said rotatable member between cooperating alignment with said gripper hands of said transfer means and alignment with said well;

(b) movable horizontally into vertical alignment with said center line of said well;

(c) and movable vertically with respect to said rig in vertical alignment with said well.

11. The apparatus of claim 10 wherein said rotatable member moves said clamping means within said legs of said derrick into alignment with said gripper hands of said transfer means.

12. The apparatus of claim 10 including centralizing means for positioning said well elements held in said clamping means in alignment with the center line of said well.

13. The apparatus of claim 12 with automatic control and sequencing means and well element indexing under any means whereby:

(a) said well element indexing means controls operation of said conveying means;

(b) said horizontal position of said rigid members controls operation of said conveyor means;

(c) said vertical position of said rigid members controls operation of said rotatable member of said manipulating means; and (d) said vertical position of said clamping means of said manipulating means controls operation of said hoist means.

14. The apparatus of claim 13 wherein said automatic control and sequencing means are separately contained and positionable away from said rig in view of said well and connected to the rig by operative connections whereby operation of said means on said rig may be controlled without operator contact with said rig or said well elements.

15. The apparatus of claim 1 wherein said pipe rack arms are adjustably pivoted about an axis parallel to said frame so as to be adjustable between sloping toward said frame and sloping away from said frame.

16. The apparatus of claim 1 wherein said crane means includes an articulated arm to provide operational access beyond said pipe rack arms.

17. The apparatus of claim 31 with a well element indexing means between said pipe rack arms and said conveying means, said indexing means including a means for locating said well elements with respect to said conveying means, and means gating said well elements into said locating means.

18. The apparatus of claim 17 wherein said conveying means comprises a vertical guide member adjacent to each of said pipe rack arms with said pipe rack arms between said guide members, and means movable along said guide members to convey said individual well elements between said pipe rack arms and said transfer means.

19. The apparatus of claim 18 wherein said means movable along said guide members includes a conveyor element and means for moving said conveyor element in a manner to maintain said conveyor element in a continuous axial orientation with respect to said guide members.

20. The apparatus of claim 18 wherein said means for moving said conveyor element places said conveyor element in alignment with said indexing means, and said conveyor element having an indexing construction whereby well elements are indexed into said conveyor element in alignment for indexing into said transfer means.

21. The apparatus of claim 19 wherein said means for moving said conveyor element includes:

(a) a pair of side plates on said conveyor means, and plates having an outside guide surface and an inside slot guide, said slot guides on said side plates being aligned with respect to each other to maintain said continuous axial orientation of said conveyor element, (b) arms pivotally connected to said conveyor element at one end and having pins at the opposite ends positioned in said slot guide, (c) a roller on one of said arms cooperating with said outside guide surface of one of said side plates; and (d) an endless belt drive means for moving said roller on said one of said arms with respect to said side plate to move said conveyor element.

22. The apparatus of claim 1 wherein said coupling means includes automatically operated means for coupling and/or uncoupling well elements in said manipulating means of said rig with well elements within said well comprising:

(a) automatically operated slips for preventing vertical movement of said well element with respect to said well, (b) means for locating a joint between well elements where said coupling and/or uncoupling is to be effected, (c) automatically operated rotatable tongs for rotating said well element with respect to said well so as to couple and/or uncouple said well element from said well elements within said well, (d) and sequence control means in said control means for operating said slips, said means for locating, and said tongs.

23. The apparatus of claim 22 with the addition of:

(a) a set of elevator jaws, (b) power operated drawworks including cable means connecting said elevator jaws to said drawworks for moving said jaws with respect to said well, (c) said drawworks including clutch and brake means, (d) said elevator jaws, drawworks, clutch and brake being controlled by said control means to effect sequential control thereof.

24. The apparatus of claim 1 with the improvement of an engine driven hydraulic and pneumatic pump means for supplying hydraulic and pneumatic pressure to said means and said control, and means for regulating said hydraulic and pneumatic pressure to operate said movable rig and to drive said movable rig from place to place.

25. The method of handling well elements between vertical alignment with the center line of a well and horizontal storage position with a totally contained well servicing rig wherein said well elements include tubular well elements and rod well elements having an upset adjacent to the flat on said rod well elements comprising the steps of:

(a) providing a horizontal well element storage area attached to and horizontally at the side of said rig;

(b) rotating individual well elements between horizontal and vertical position;

(c) placing said vertical well elements in alignment with the axis of said well;

(d) moving said well elements into alignment with the center line of said well;

(e) and positioning said well elements into engagement with said other well elements within said well wherein said positioning of said well elements is controlled for tubular well elements by sensing couplings between elements and wherein for rod well elements by sensing the location of the upset adjacent to the flat on said rod well elements.

26. A totally contained movable rig for servicing and drilling and for handling elongated well elements from a horizontal storage position to a vertical position in operating relationship with a well, or the reverse of said positions, said rig having a forward end, a rear end, with right and left sides established with respect to facing said forward end from said rear end, and engine means mounted on said rig for moving said rig on a conventional roadway system; said rig, when in position to service, drill or handle well elements, comprising:

(a) horizontal storing means at each side of said rig for storing said well elements parallel to said sides of said rig and in horizontal position with regard to a surface supporting said rig;

(b) conveying means at each side of said rig for conveying individual well elements from said horizontal storing means to a transfer location said conveying means being vertically operable about horizontal axes parallel to said sides of said rig for conveying said well elements horizontally parallel to each of said sides of said rig;

(c) transfer means at each side of said rig including means for holding said individual well elements at said transfer location and means for rotating each of said transfer means to a vertical position about a horizontal axis for each adjacent to the forward end of said rig to position said transfer means and a well element therewith adjacent to the center line of said well and parallel thereto;

(d) manipulating means adjacent to said forward end of said rig including means for grasping said well element from either of said transfer means when either of said transfer means is in its vertical position and for moving said well element to position the longitudinal axis of said well element in alignment with the center line of said well;

(e) means for moving including means for engaging said well element in alignment with the center line of said well and for moving said well element along said longitudinal axis thereof into operative position with respect to said well;

(f) coupling means for coupling said well element engaged by said means for moving to similar well elements within said well;

(g) and control means for sequencing the operation of said conveying means, said transfer means, said manipulating means, said means for moving, and said coupling means to accomplish said handling of said well elements into and out of said operating relationship with said well totally automatically.

27. The apparatus of claim 26 wherein said horizontal storing means, said conveying means, said transfer means, said manipulating means, said means for moving and said coupling means are pivotally mounted on a frame of said movable rig and are adapted to be placed in operative position when said rig is positioned for operation with respect to a well, and said foregoing means are movable about said pivotal mountings and stored on said rig when said rig is being moved from place to place.

28. The apparatus of claim 27 wherein said horizontal storing means for said well elements includes:

(a) a pair of pipe rack arms pivotally mounted on each side of said frame of said movable rig so as to be pivoted about a vertical axis between stored position in alignment with said frame and operating position generally horizontal and perpendicular to said frame;

(b) a pair of crane means rotatably mounted on said frame one at each side of said movable well drilling rig so as to be in operational relationship with said pairs of pipe rack arms to load and unload said elongated well elements from said pipe rack arms.

29. The apparatus of claim 28 wherein said pairs of pipe rack arms are adjustably pivoted about an axis parallel to said frame so as to be adjustable between sloping toward said frame and sloping away from said frame.

30. The apparatus of claim 28 wherein each of said crane means includes an articulated arm to provide operational access beyond said pipe rack arms.

31. The apparatus of claim 26 with the addition of a derrick at the forward end of said rig, said derrick having a pair of legs pivotally mounted on said rig, an upper crossmember fixed to said legs for supporting a crown block and hoist means above and in alignment with said well bore, and guy means for said derrick connected to each side of said rig to provide stabilization therefor; said legs and guy means being spaced with respect to each other to permit said transfer means to rotate from horizontal to vertical position and said manipulating means to operate between said legs to engaging position with either of said transfer means and without interference with said guy means or said legs.

* * * * *